United States Patent [19]

Ogawa et al.

[11] Patent Number: 4,511,649

[45] Date of Patent: Apr. 16, 1985

[54] SILVER HALIDE COLOR PHOTOGRAPHIC LIGHT-SENSITIVE MATERIAL

[75] Inventors: Akira Ogawa; Momotoshi Tsuda, both of Kanagawa, Japan

[73] Assignee: Fuji Photo Film Co., Ltd., Kanagawa, Japan

[21] Appl. No.: 612,499

[22] Filed: May 21, 1984

[30] Foreign Application Priority Data

May 20, 1983 [JP] Japan ..... 58-88940

[51] Int. Cl.[3] ..... G03C 7/26; G03C 7/32

[52] U.S. Cl. ..... 430/553; 430/216; 430/226; 430/385; 430/387; 430/389; 430/505; 430/555; 430/557; 430/558

[58] Field of Search ..... 430/385, 387, 389, 553, 430/555, 557, 558, 505, 216, 226

[56] References Cited

U.S. PATENT DOCUMENTS

| | | | |
|---|---|---|---|
| 4,133,955 | 1/1979 | Renner | 430/557 X |
| 4,401,752 | 8/1983 | Lau | 430/557 X |
| 4,420,556 | 12/1983 | Booms et al. | 430/557 X |
| 4,421,845 | 12/1983 | Uemura et al. | 430/557 X |
| 4,438,193 | 3/1984 | Uemura et al. | 430/555 X |
| 4,477,560 | 10/1984 | Koitabashi et al. | 430/558 X |

*Primary Examiner*—John Kittle
*Assistant Examiner*—Mukund J. Shah
*Attorney, Agent, or Firm*—Sughrue, Mion, Zinn, Macpeak and Seas

[57] ABSTRACT

A silver halide color photographic light-sensitive material comprising a support having thereon at least one silver halide emulsion layer is described, the color photographic light-sensitive material containing a coupler having at the coupling position thereof a group represented by formula (I)

(I)

wherein Z represents an oxygen atom or a sulfur atom; $R_1$ and $R_2$ each represents a halogen atom, an alkyl group, an aryl group, an aralkyl group, an alkoxy group, an aryloxy group, a cyano group, a nitro group, a hydroxy group, a carboxy group, an alkoxycarbonyl group, an aryloxycarbonyl group, an alkylsulfonamido group, an arylsulfonamido group, an alkylsulfamoyl group, an arylsulfamoyl group, an acylamino group, an amino group, an alkylcarbamoyl group, an arylcarbamoyl group, an alkylsulfonyl group, an arylsulfonyl group, an alkylcarbonyl group or an arylcarbonyl group; $X_1$ represents a divalent organic connecting group; l is 0 or 1; and n and m each is 0, 1, 2, 3 or 4 and the total number of n+m is 1 to 8, when n or m represents 2 or more the $R_1$ or $R_2$ groups may be the same or different.

The silver halide color photographic light-sensitive material containing the 2-equivalent coupler having a group capable of being released upon a coupling reaction represented by formula (I) has excellent color forming properties even when it is processed in a color developing solution which does not contain an organic solvent for accelerating color formation, such as benzyl alcohol. A method of forming a color image using the silver halide color photographic light-sensitive material is also disclosed.

27 Claims, No Drawings

SILVER HALIDE COLOR PHOTOGRAPHIC LIGHT-SENSITIVE MATERIAL

FIELD OF THE INVENTION

The present invention relates to a photographic coupler. More particularly, it relates to a color photographic light-sensitive material containing a novel 2-equivalent coupler.

BACKGROUND OF THE INVENTION

It is known that, by the color development of a silver halide color photographic material, an oxidized aromatic primary amine developing agent can react with a coupler to form a dye such as an indophenol, an indoaniline, an indamine, an azomethine, a phenoxazine, a quinoneimine, a phenazine, and the like, thus forming a color image (for example, refer to T. H. James, *The Theory of the Photographic Process,* 3rd Edition, pages 382 to 396, Macmillan Co., New York (1971)). In this procedure, the subtractive color process is ordinarily used for color reproduction, and silver halide emulsions which are selectively sensitive to blue, green, and red lights, and yellow, magenta, and cyan color image formers, which are respectively the complementary colors of blue, green, and red, are employed. For example, a coupler of the acylacetanilide, malondianilide or dibenzoylmethane type is used for forming a yellow color image; a coupler of the pyrazolone, pyrazolobenzimidazole, cyanoacetophenone, pyrazolotriazole or indazolone type is generally used for forming a magenta color image; and a phenolic coupler, such as a phenol and a naphthol, is used for forming a cyan color image.

Color photographic light-sensitive materials are roughly divided into two classes, one of which is a coupler-in-developer type color photographic light-sensitive material wherein a coupler is added to a developing solution, and the other of which is a coupler-in-emulsion type color photographic light-sensitive material wherein a coupler is incorporated into each light-sensitive layer of the photographic material so as to maintain the independent function thereof. In the latter photographic material a dye image forming coupler is added to a silver halide emulsion layer. It is required that a coupler added to an emulsion layer be rendered nondiffusible (diffusion-resistant) in a binder matrix of the emulsion layer.

On the other hand, 2-equivalent couplers in which a group capable of being released upon the coupling reaction with an oxidized product of a developing agent is substituted at the coupling position thereof are also known. A 2-equivalent coupler can form 1 mole of dye using 2 moles of silver, although at least 4 moles of silver are required by a 4-equivalent coupler in order to form 1 mole of dye. Therefore, it is possible to reduce the amount of silver coated in the photographic light-sensitive material by employing a 2-equivalent coupler, resulting in a decrease in production costs and a reduction in the film thickness.

Although 2-equivalent couplers are known having satisfactory characteristics, it has still been desired to improve their properties. In particular, many known 2-equivalent couplers are insufficient with respect to color forming properties in high temperature rapid processings that have recently become popular. In order to compensate for such insufficient color forming properties, organic solvents such as benzyl alcohol, etc., have been added to a developing solution as an accelerator for color formation. However, such organic solvents for accelerating the color formation have several problems. For example, (1) since they are absorbed into emulsion layers during development, the amount thereof decreases in the developing solution, and thus the color formation becomes poor; (2) they are brought into the bleaching solution or bleach-fixing solution, and thus hinder desilvering or cause decrease in dye density; (3) they remain in the photographic material after processing and adversely affect the fastness of the dye images; and (4) they are mixed in processing wastes and cause undesirable increases in the biochemical oxygen demand (BOD) and chemical oxygen demand (COD) of the wastes.

For these reasons it has been eagerly desired to remove the organic solvents for accelerating color formation or reduce the amount thereof.

2-equivalent couplers of aryloxy releasing type are described, for example, in British Pat. No. 1,077,874, U.S. Pat. Nos. 3,419,391 and 3,476,563, Japanese Patent Application (OPI) No. 87650/75 (the term "OPI" as used herein refers to a "published unexamined Japanese patent application"), etc. However, these 2-equivalent couplers of aryloxy releasing type are still insufficient in view of the color forming properties. Further, couplers containing a diffusion-resistant group having a p-hydroxyphenylsulfonyl group or a p-hydroxyphenylsulfinyl group at a terminus thereof as described in Japanese Patent Application (OPI) No. 42045/83 have been recently proposed. These couplers are recognized to have improved color forming properties in comparison with conventionally known couplers due to the functions of the diffusion-resistant group. However, the improvement is still not totally satisfactory, and they are disadvantageous because they have low solubility in organic solvents for dispersing couplers.

SUMMARY OF THE INVENTION

Therefore, an object of the present invention is to provide a coupler which has an excellent color forming property, eliminating the drawbacks present in known couplers and which is suitable for use in color photographic light-sensitive materials.

Another object of the present invention is to provide a color photographic light-sensitive material having a sufficiently high color forming property even when it is processed in a color developing solution which does not contain an organic solvent for accelerating color formation such as benzyl alcohol, etc.

These and other objects of the present invention will become more apparent from the following detailed description and examples.

It has now been found that these objects of the present invention are accomplished by a silver halide color photographic light-sensitive material comprising a support having thereon at least one silver halide emulsion layer, the color photographic light-sensitive material containing a coupler having at the coupling position thereof a group represented by formula (I):

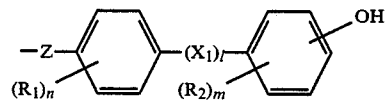

(I)

wherein Z represents an oxygen atom or a sulfur atom; $R_1$ and $R_2$ each represents a halogen atom, an alkyl group, an aryl group, an aralkyl group, an alkoxy group, an aryloxy group, a cyano group, a nitro group, a hydroxy group, a carboxy group, an alkoxycarbonyl group, an aryloxycarbonyl group, an alkylsulfonamido group, an arylsulfonamido group, an alkylsulfamoyl group, an arylsulfamoyl group, an acylamino group, an amino group, an alkylcarbamoyl group, an arylcarbamoyl group, an alkylsulfonyl group, an arylsulfonyl group, an alkylcarbonyl group or an arylcarbonyl group; $X_1$ represents a divalent organic connecting group; l is 0 or 1; and n and m each is 0, 1, 2, 3 or 4 and the total number of n+m is 1 to 8, and when n or m represents 2 or more the $R_1$ or $R_2$ groups may be the same or different.

DETAILED DESCRIPTION OF THE INVENTION

Of the couplers according to the present invention, preferred couplers are those represented by formula (II):

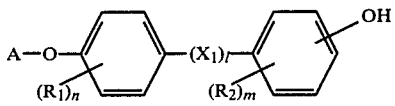

(II)

wherein A represents a coupler residue in which one hydrogen atom at the coupling position is eliminated; and $R_1$, $R_2$, $X_1$, l, m and n each has the same meaning as defined for formula (I).

More preferred couplers of the couplers according to the present invention are those represented by formula (III):

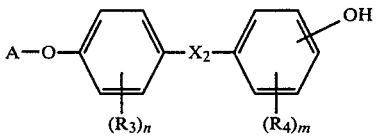

(III)

wherein $R_3$ and $R_4$ each represents a halogen atom, an alkyl group, an alkoxy group, a cyano group, a nitro group, an alkoxycarbonyl group, an aryloxycarbonyl group, an alkylsulfonyl group, or an arylsulfonyl group; $X_2$ represents a divalent organic connecting group selected from an alkylene group, —O—,

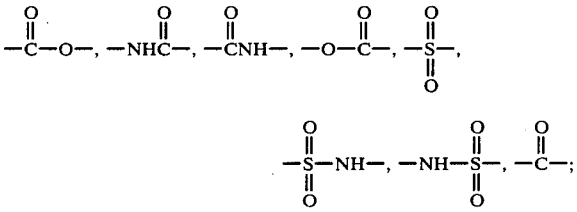

and A, n and m each has the same meaning as defined for formula (II).

Most preferred couplers of the couplers according to the present invention are those represented by formula (IV):

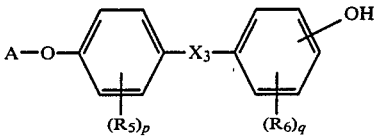

(IV)

wherein $R_5$ and $R_6$ each represents a halogen atom, an alkyl group, an alkoxy group, a cyano group, a nitro group or an alkylsulfonyl group; $X_3$ represents a group selected from

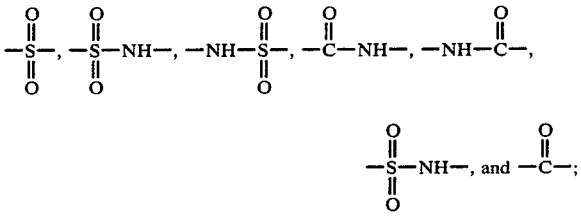

p and q each is 0, 1 or 2 and the total number of p+q is 1, 2, 3 or 4; and A has the same meaning as defined for formula (II).

The couplers according to the present invention are required to be rendered diffusion-resistant since they are employed by adding them to an emulsion layer. The diffusion-resistant group is a group which sufficiently increases the molecular weight of the coupler to prevent the coupler from diffusing from an emulsion layer to which the coupler has been added and generally it is an organic group having 10 or more carbon atoms. The effects of the present invention are equivalent where the diffusion-resistant group is included in any of A, $X_1$, $R_1$ and $R_2$ in formula (II).

In formula (II), suitable examples of the yellow color image forming coupler residue represented by A include those of pivaloyl acetanilide type, benzoyl acetanilide type, malonic diester type, malondiamide type, dibenzoylmethane type, benzothiazolyl acetamide type, malonic ester monoamide type, benzothiazolyl acetate type, benzoxazolyl acetamide type, benzoxazolyl acetate type, benzimidazolyl acetamide type and benzimidazolyl acetate type; the coupler residues derived from hetero ring-substituted acetamides or hetero ring-substituted acetates described in U.S. Pat. No. 3,841,880; the coupler residues derived from the acyl acetamides as described in U.S. Pat. No. 3,770,446, British Pat. No. 1,459,171, West German Patent Application (OLS) No. 2,503,099, Japanese Patent Application (OPI) No. 139738/75 and *Research Disclosure,* No. 15737; and the hetero ring type coupler residues as described in U.S. Pat. No. 4,046,574, etc.

Suitable examples of the magenta color image forming coupler residue represented by A include those of 5-oxo-2-pyrazoline type, pyrazolobenzimidazole type, pyrazolotriazole cyanoacetophenone type, pyrazoloimidazole type; and N-hetero ring-substituted acylacetamide type coupler residues as described in West German Patent Application (OLS) No. 3,121,955, etc.

Suitable examples of the cyan color image forming coupler residue represented by A include those having a phenol nucleus or an α-naphthol nucleus.

Suitable examples of substantially non-color forming coupler residue represented by A include those of indanone type, acetophenone type, etc., and specific examples thereof are described in U.S. Pat. Nos. 4,052,213, 4,088,491, 3,632,345, 3,958,993, 3,961,959, 4,046,574 and 3,938,996, etc. Such kinds of compounds are competed with dye forming couplers in the reaction with the oxidation product of a developing agent and thus provide effects of controlling gradation and improving in graininess.

The effects of the present invention are particularly exhibited when A in formula (II) represents a coupler residue represented by one of formulae (V), (VI), (VII), (VIII), (IX), (X), (XI), (XII), (XIII), (XIV) or (XV) described below.

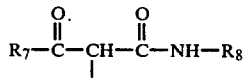

(V)

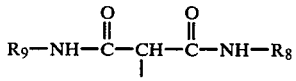

(VI)

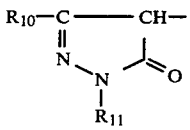

(VII)

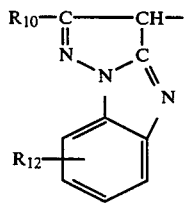

(VIII)

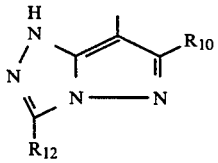

(IX)

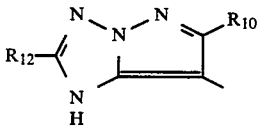

(X)

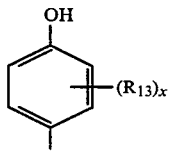

(XI)

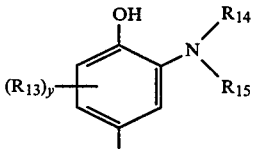

(XII)

-continued

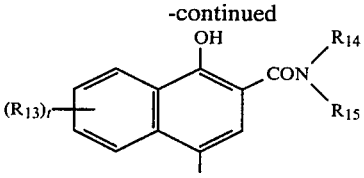

(XIII)

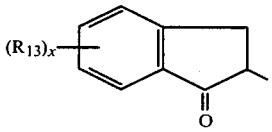

(XIV)

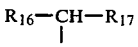

(XV)

In the above-described formulae, a free bond attached to the coupling position indicates the position to which a group capable of being released upon coupling is bonded. When $R_7$, $R_8$, $R_9$, $R_{10}$, $R_{11}$, $R_{12}$, $R_{13}$, $R_{14}$, $R_{15}$, $R_{16}$ or $R_{17}$ in the above-described formulae contains a diffusion-resistant group, it is so selected that the total number of carbon atoms included therein is from 8 to 32, and preferably from 10 to 22. On the other hand, when it does not contain a diffusion-resistant group, the total number of carbon atoms included therein is preferably not more than 15.

In the following, $R_7$ to $R_{17}$, x, y and t in the above described formulae (V) to (XV) are explained.

In the above-described formulae (V) and (VI), $R_7$ represents an aliphatic group, an aromatic group, an alkoxy group or a heterocyclic group; and $R_8$ and $R_9$ each represents an aromatic group or a heterocyclic group.

The aliphatic group represented by $R_7$ is preferably an aliphatic group containing from 1 to 22 carbon atoms, may be substituted or not, and further may have a chain form or a cyclic form. Preferable substituents for an alkyl group include an alkoxy group, an aryloxy group, an amino group, an acylamino group, a halogen atom, etc., which each may further have a substituent(s). Specific examples of aliphatic groups useful for $R_7$ include an isopropyl group, an isobutyl group, a tert-butyl group, an isoamyl group, a tert-amyl group, a 1,1-dimethylbutyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an α-aminoisopropyl group, an α-(diethylamino)isopropyl group, an α-(succinimido)isopropyl group, an α-(phthalimido)isopropyl group, an α-(benzenesulfonamido)isopropyl group, etc.

In the case that $R_7$, $R_8$ or $R_9$ represents an aromatic group, especially a phenyl group, it may have a substituent. Such an aromatic group as a phenyl group, etc., may be substituted with an alkyl group, an alkenyl group, an alkoxy group, an alkoxycarbonyl group, an alkoxycarbonylamino group, an aliphatic amido group, an alkylsulfamoyl group, an alkylsulfonamido group, an alkylureido group, alkyl-substituted succinimido group, etc., each containing 32 or less carbon atoms. The alkyl group therein may include an alkyl group which contains an aromatic group such as phenylene in its main chain. Further, a phenyl group represented by $R_7$, $R_8$ or $R_9$ may be substituted with an aryloxy group, an aryloxycarbonyl group, an arylcarbamoyl group, an arylamido group, an arylsulfamoyl group, an arylsulfonamido group, an arylureido group, etc., the aryl moiety of which groups each may be substituted with one or more alkyl groups wherein the number of carbon atoms is from 1 to 22 in total.

Furthermore, a phenyl group represented by $R_7$, $R_8$, or $R_9$ may be substituted with an amino group which includes an amino group substituted with a lower alkyl group having from 1 to 6 carbon atoms, a hydroxy group, a carboxy group, a sulfo group, a nitro group, a cyano group, a thiocyano group or a halogen atom.

In addition, $R_7$, $R_8$, or $R_9$ may represent a substituent formed by condensing a phenyl group and another ring, such as a naphthyl group, a quinolyl group, an isoquinolyl group, a chromanyl group, a coumaranyl group, a tetrahydronaphthyl group, etc. These substituents may further have one or more substituents in themselves.

In the case that $R_7$ represents an alkoxy group, the alkyl moiety thereof represents a straight chain or branched chain alkyl group having from 1 to 32 carbon atoms, preferably from 1 to 22 carbon atoms, an alkenyl group, a cyclic alkyl group or a cyclic alkenyl group, which each may be substituted with a halogen atom, an aryl group, an alkoxy group, etc.

In the case that $R_7$, $R_8$ or $R_9$ represents a heterocyclic group, the heterocyclic group is bonded to the carbon atom of the carbonyl group of the acyl moiety or the nitrogen atom of the amino moiety of an $\alpha$-acylacetamido group through one of the carbon atoms forming the ring. Examples of such heterocyclic rings include thiophene, furan, pyran, pyrrole, pyrazole, pyridine, pyrazine, pyrimidine, pyridazine, indolizine, imidazole, thiazole, oxazole, triazine, thiadiazine, oxazine, etc. These rings may further have substituents on the individual rings.

$R_{11}$ in formula (VII) represents a straight chain or branched chain alkyl group having from 1 to 32 carbon atoms, preferably from 1 to 22 carbon atoms (e.g., a methyl group, an isopropyl group, a tert-butyl group, a hexyl group, a dodecyl group, etc.), an alkenyl group (e.g., an allyl group, etc.), a cyclic alkyl group (e.g., a cyclopentyl group, a cyclohexyl group, a norbornyl group, etc.), an aralkyl group (e.g., a benzyl group, a $\beta$-phenylethyl group, etc.), a cyclic alkenyl group (e.g., a cyclopentenyl group, a cyclohexenyl group, etc.), etc., which groups each may be substituted with a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group, a mercapto group, etc.

$R_{11}$ in formula (VII) may further represent an aryl group (e.g., a phenyl group, an $\alpha$- or $\beta$-naphthyl group, etc.). The aryl group may have one or more substituents. Specific examples of the substituents include an alkyl group, an alkenyl group, a cyclic alkyl group, an aralkyl group, a cyclic alkenyl group, a halogen atom, a nitro group, a cyano group, an aryl group, an alkoxy group, an aryloxy group, a carboxy group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxy group, a mercapto group, etc. A more preferable substituent for $R_{11}$ is a phenyl group which is substituted with an alkyl group, an alkoxy group, a halogen atom, etc., at at least one of the o-positions thereof, because it is effective to restrain coloration of couplers remaining in film layers due to light or heat.

Furthermore, $R_{11}$ may represent a heterocyclic group (e.g., a 5-membered or 6-membered heterocyclic ring containing as a hetero atom a nitrogen atom, an oxygen atom or a sulfur atom, or a condensed ring thereof, with specific examples including a pyridyl group, a quinolyl group, a furyl group, a benzothiazolyl group, an oxazolyl group, an imidazolyl group, a naphthoxazolyl group, etc.), a heterocyclic group substituted with one or more substituents as defined for the above-described aryl group, an aliphatic acyl group, an aromatic acyl group, an alkylsulfonyl group, an arylsulfonyl group, an alkylcarbamoyl group, an arylcarbamoyl group, an alkylthiocarbamoyl group or an arylthiocarbamoyl group.

$R_{10}$ in formulae (VII), (VIII), (IX) or (X) represents a hydrogen atom, a straight chain or branched chain alkyl group having from 1 to 32 carbon atoms, preferably from 1 to 22 carbon atoms, an alkenyl group, a cyclic alkyl group, an aralkyl group or a cyclic alkenyl group (which each may have one or more substituents as defined for the above-described substituent $R_{11}$), an aryl group or a heterocyclic group (which each also may have one or more substituents as defined for the above-described substituent $R_{11}$), an alkoxycarbonyl group (e.g., a methoxycarbonyl group, an ethoxycarbonyl group, a stearyloxycarbonyl group, etc.), an aryloxycarbonyl group (e.g., a phenoxycarbonyl group, a naphthoxycarbonyl group, etc.), an aralkyloxycarbonyl group (e.g., a benzyloxycarbonyl group, etc.), an alkoxy group (e.g., a methoxy group, an ethoxy group, a heptadecyloxy group, etc.), an aryloxy group (e.g., a phenoxy group, a tolyloxy group, etc.), an alkylthio group (e.g., an ethylthio group, a dodecylthio group, etc.), an arylthio group (e.g., a phenylthio group, an $\alpha$-naphthylthio group, etc.), a carboxy group, an acylamino group (e.g., an acetylamino group, a 3-[(2,4-di-tert-amylphenoxy)acetamido]benzamido group, etc.), a diacylamino group, an N-alkylacylamido group (e.g., an N-methylpropionamido group, etc.), an N-arylacylamido group (e.g., an N-phenylacetamido group, etc.), a ureido group (e.g., a ureido group, an N-arylureido group, an N-alkylureido group, etc.), a urethane group, a thiourethane group, an arylamino group (e.g., a phenylamino group, an N-methylanilino group, a diphenylamino group, an N-acetylanilino group, a 2-chloro-5-tetradecanamidoanilino group, etc.), an alkylamino group (e.g., an n-butylamino group, a methylamino group, a cyclohexylamino group, etc.), a cycloamino group (e.g., a piperidino group, a pyrrolidino group, etc.), a heterocyclic amino group (e.g., a 4-pyridylamino group, a 2-benzoxazolylamino group, etc.), an alkylcarbonyl group (e.g., a methylcarbonyl group, etc.), an arylcarbonyl group (e.g., a phenylcarbonyl group, etc.), a sulfonamido group (e.g., an alkylsulfonamido group, an arylsulfonamido group, etc.), a carbamoyl group (e.g., an ethylcarbamoyl group, a dimethylcarbamoyl group, an N-methylphenylcarbamoyl group, an N-phenylcarbamoyl group, etc.), a sulfamoyl group (e.g., an N-alkylsulfamoyl group, an N,N-dialkylsulfamoyl group, an N-arylsulfamoyl group, an N-alkyl-N-arylsulfamoyl group, an N,N-diarylsulfamoyl group, etc.), a cyano group, a hydroxy group, a mercapto group, a halogen atom or a sulfo group.

$R_{12}$ in formulae (VIII), (IX) and (X) represents a hydrogen atom, a straight chain or branched chain alkyl group having from 1 to 32 carbon atoms, preferably from 1 to 22 carbon atoms, an alkenyl group, a cyclic alkyl group, an aralkyl group or a cyclic alkenyl group, which each may have one or more substituents as defined for the above-described substituent $R_{11}$.

Further, $R_{12}$ may represent an aryl group or a heterocyclic group, which each may have one or more substituents as defined for the above described substituent $R_{11}$.

Furthermore, $R_{12}$ may represent a cyano group, an alkoxy group, an aryloxy group, a halogen atom, a carboxy group, an alkoxycarbonyl group, an aryloxycarbonyl group, an acyloxy group, a sulfo group, a sulfamoyl group, a carbamoyl group, an acylamino group, a diacylamino group, a ureido group, a urethane group, a sulfonamido group, a arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group or a mercapto group.

$R_{13}$, $R_{14}$, and $R_{15}$ in formulae (XI), (XII), (XIII), or (XIV) represent groups which have been employed in conventional 4-equivalent type phenol or $\alpha$-naphthol couplers. Specifically, $R_{13}$ represents a hydrogen atom, a halogen atom, an alkoxycarbonylamino group, an aliphatic hydrocarbon residue, an N-arylureido group, an acylamino group, an —O—$R_{18}$ group or an —S—$R_{18}$ group, wherein $R_{18}$ is an aliphatic hydrocarbon residue. When two or more $R_{13}$ groups are present in one molecule, they may be different from each other. The above-described aliphatic hydrocarbon residues include those having substituents. In the case that these substituents include an aryl group, the aryl group may have one or more substituents as defined for the above-described substituent $R_{11}$.

$R_{14}$ and $R_{15}$ each represents an aliphatic hydrocarbon residue, an aryl group or a heterocyclic group. Either of them may be a hydrogen atom. The above-described groups for $R_{14}$ and $R_{15}$ may further have certain substituents. Furthermore, $R_{14}$ and $R_{15}$ may combine with each other and form a nitrogen-containing heterocyclic nucleus. More specifically, the above-described aliphatic hydrocarbon residue includes both saturated and unsaturated ones, which each may have a straight chain form, a branched chain form or a cyclic form. Preferred examples thereof include an alkyl group (e.g., a methyl group, an ethyl group, a propyl group, an isopropyl group, a butyl group, a t-butyl group, an isobutyl group, a dodecyl group, an octadecyl group, a cyclobutyl group, a cyclohexyl group, etc.) and an alkenyl group (e.g., an allyl group, an octenyl group, etc.). The above-described aryl group includes a phenyl group, a naphthyl group, etc. Representatives of the above-described heterocyclic group include a pyridinyl group, a quinolyl group, a thienyl group, a piperidyl group, an imidazolyl group, etc. These aliphatic hydrocarbon residues, aryl groups and heterocyclic groups each may be substituted with a halogen atom, a nitro group, a hydroxy group, a carboxy group, an amino group, a substituted amino group, a sulfo group, an alkyl group, an alkenyl group, an aryl group, a heterocyclic group, an alkoxy group, an aryloxy group, an arylthio group, an arylazo group, an acylamino group, a carbamoyl group, an ester group, an acyl group, an acyloxy group, a sulfonamido group, a sulfamoyl group, a sulfonyl group, a morpholino group, etc.

In the above-described formulae, x is an integer of from 1 to 4, y is an integer of from 1 to 3, and t is an integer of from 1 to 5.

$R_{16}$ in formula (XV) represents an arylcarbonyl group, an alkanoyl group having from 2 to 32 carbon atoms, preferably from 2 to 22 carbon atoms, an arylcarbamoyl group, an alkanecarbamoyl group having from 2 to 32 carbon atoms, preferably from 2 to 22 carbon atoms, an alkoxycarbonyl group having from 1 to 32 carbon atoms, preferably from 1 to 22 carbon atoms, or an aryloxycarbonyl group, which each may be substituted. Examples of the substituents include an alkoxy group, an alkoxycarbonyl group, an acylamino group, an alkylsulfamoyl group, an alkylsulfonamido group, an alkylsuccinimido group, a halogen atom, a nitro group, a carboxy group, a nitrile group, an alkyl group, an aryl group, etc.

$R_{17}$ in formula (XV) represents an arylcarbonyl group, an alkanoyl group having from 2 to 32 carbon atoms, preferably from 2 to 22 carbon atoms, an arylcarbamoyl group, an alkanecarbamoyl group having from 2 to 32 carbon atoms, preferably from 2 to 22 carbon atoms, an alkoxycarbonyl group having from 1 to 32 carbon atoms, preferably from 1 to 22 carbon atoms, an aryloxycarbonyl group, an alkanesulfonyl group having from 1 to 32 carbon atoms, preferably from 1 to 22 carbon atoms, an arylsulfonyl group, an aryl group or a 5-membered or 6-membered heterocyclic group (containing as a hetero atom a nitrogen atom, an oxygen atom or a sulfur atom, with specific examples including a triazolyl group, an imidazolyl group, a phthalimido group, a succinimido group, a furyl group, a pyridyl group, a benzotriazolyl group, etc.), which each may have one or more substituents as defined for $R_{16}$ as described above.

In formula (IV), a particularly preferred coupler residue represented by A is a coupler residue represented by formula (V) wherein $R_7$ represents a tertbutyl group and $R_8$ represents an aromatic group.

Specific examples of the couplers which can be effectively used in the present invention are illustrated below, but the present invention should not be construed as being limited thereto.

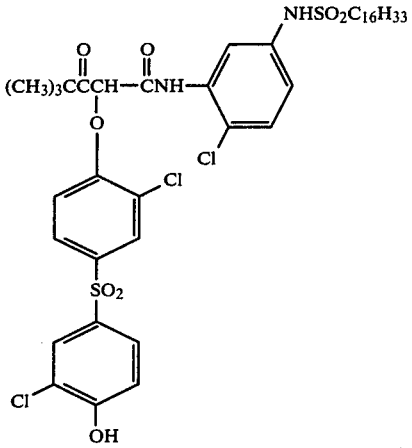
(1)
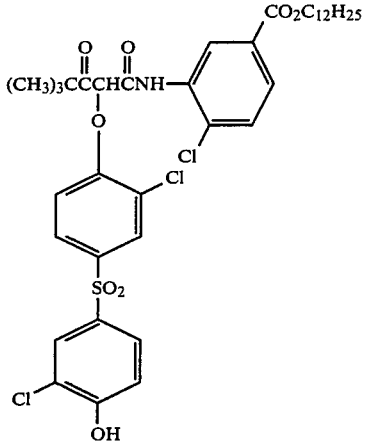
(2)
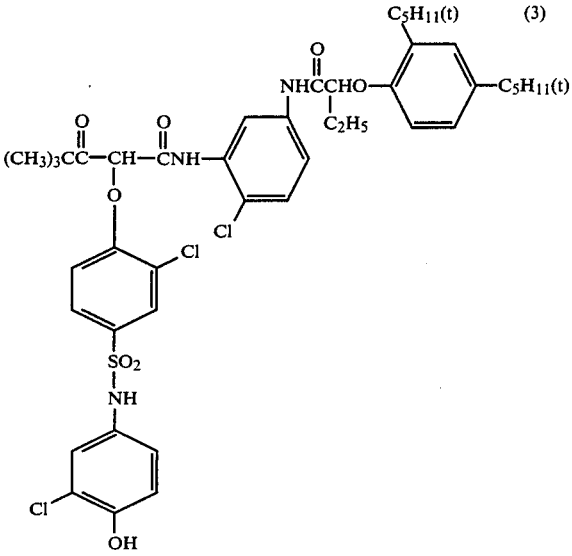
(3)
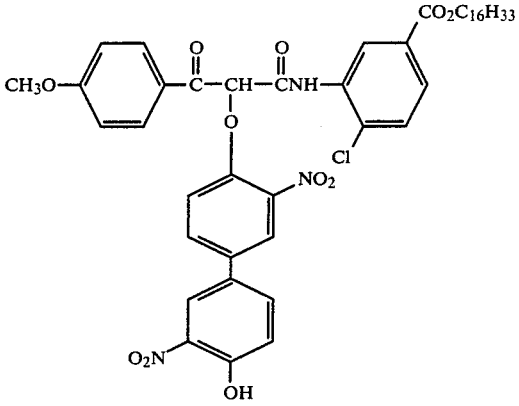
(4)
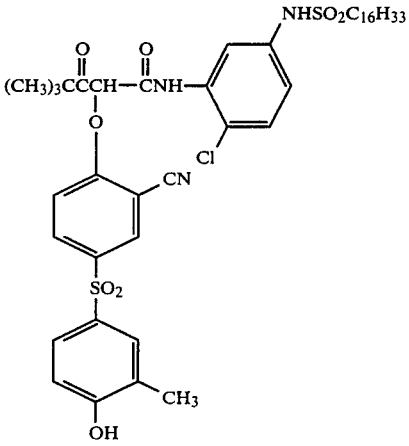
(5)
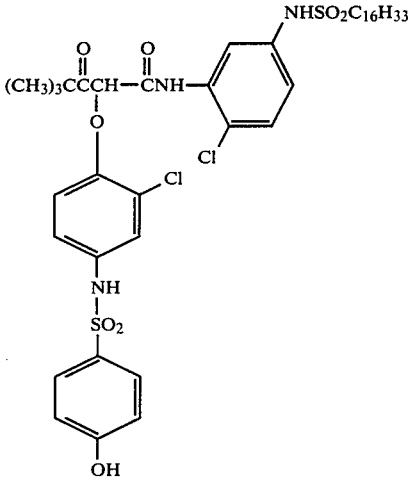
(6)

-continued
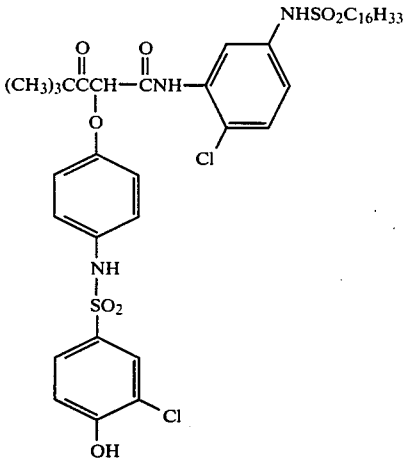
(7)
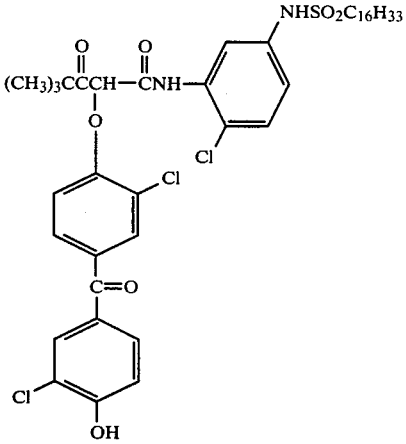
(8)
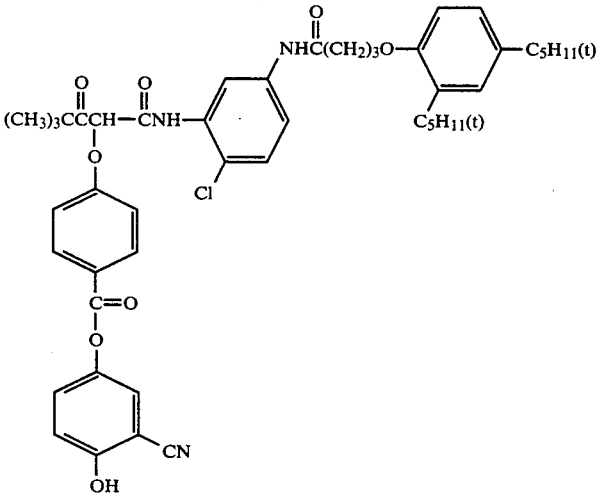
(9)
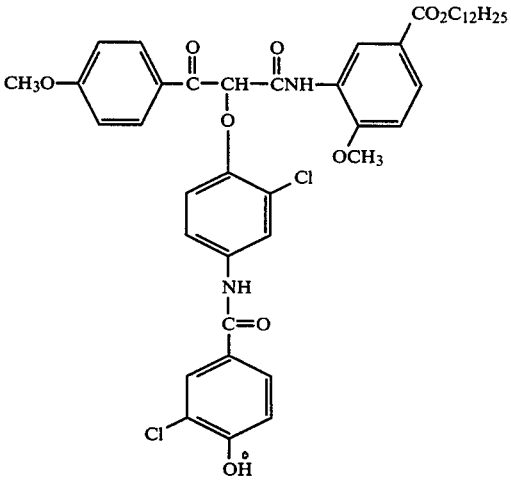
(10)
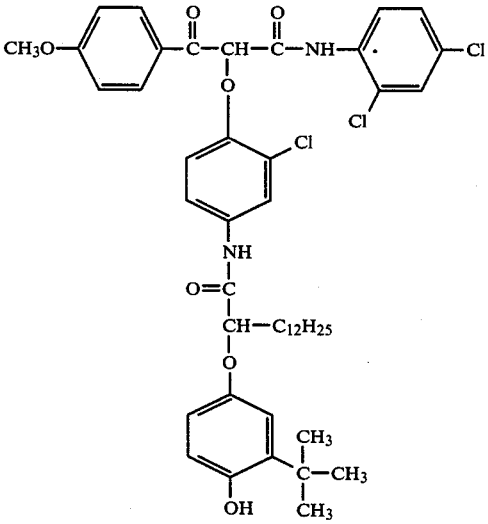
(11)

-continued
(12)
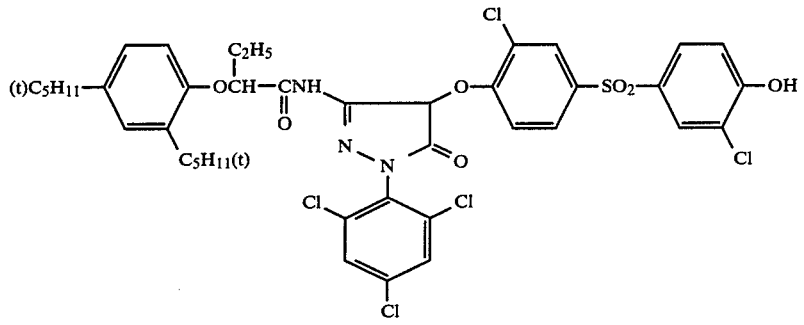
(13)
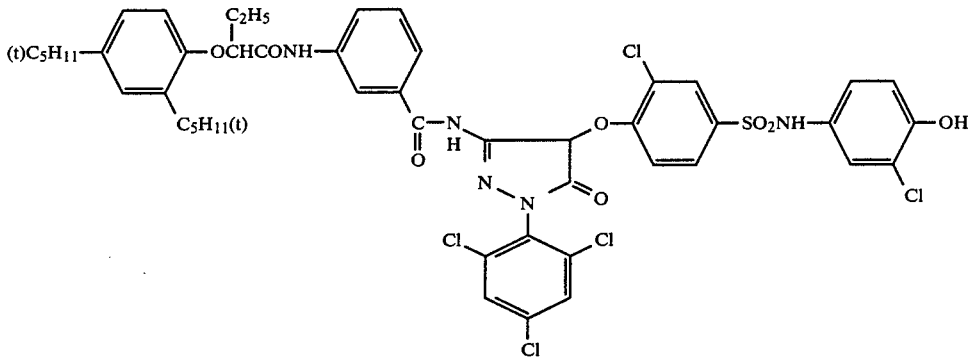
(14)
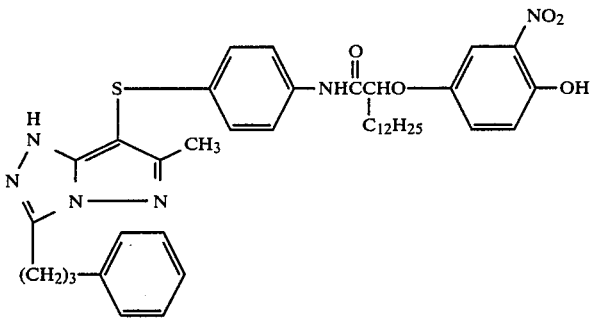
(15)
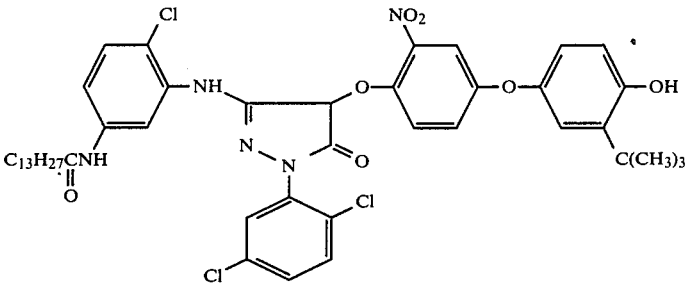

-continued
(16)
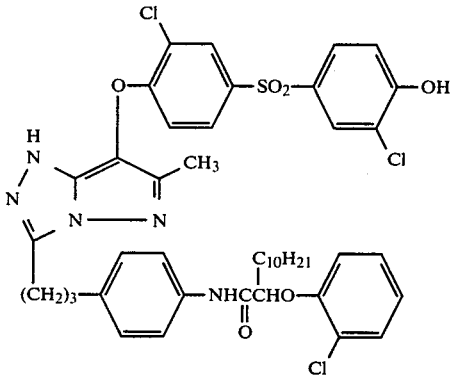
(17)
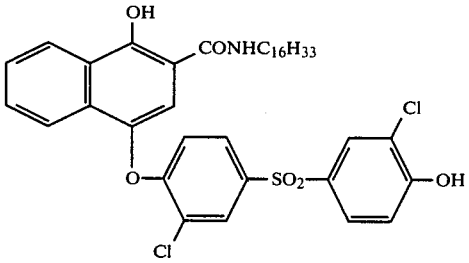
(18)
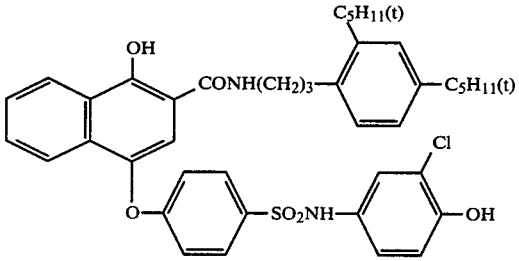
(19)
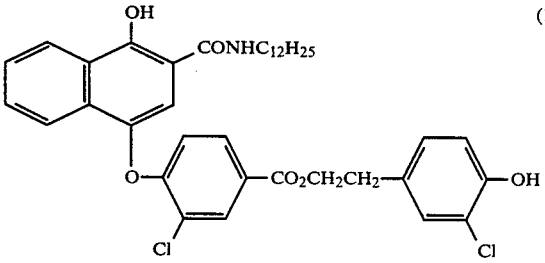
(20)
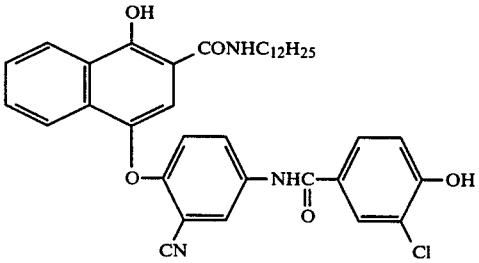
(21)
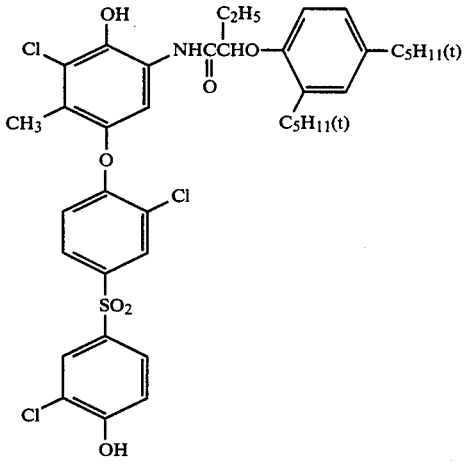
(22)
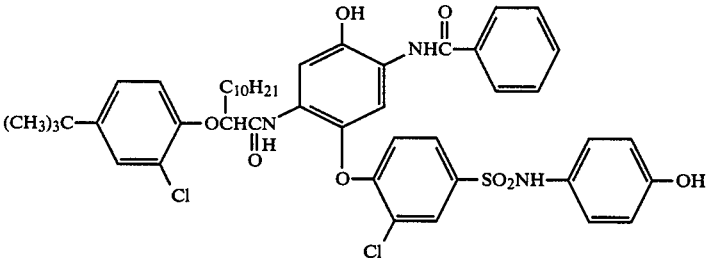

-continued (23)

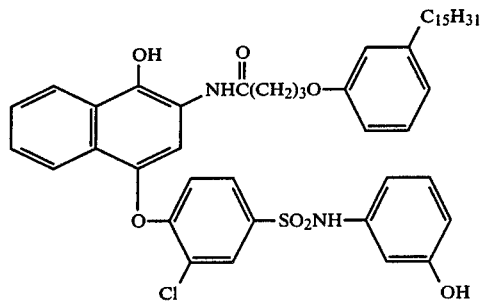

(24)

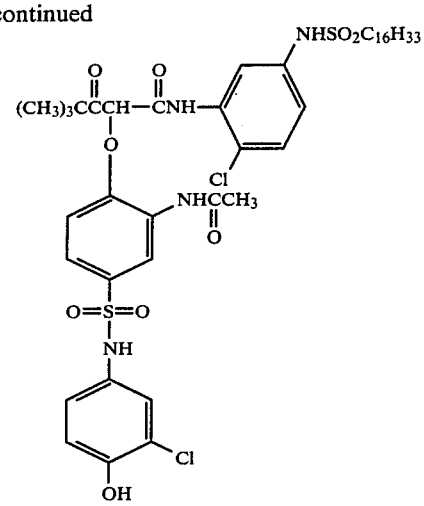

(25)

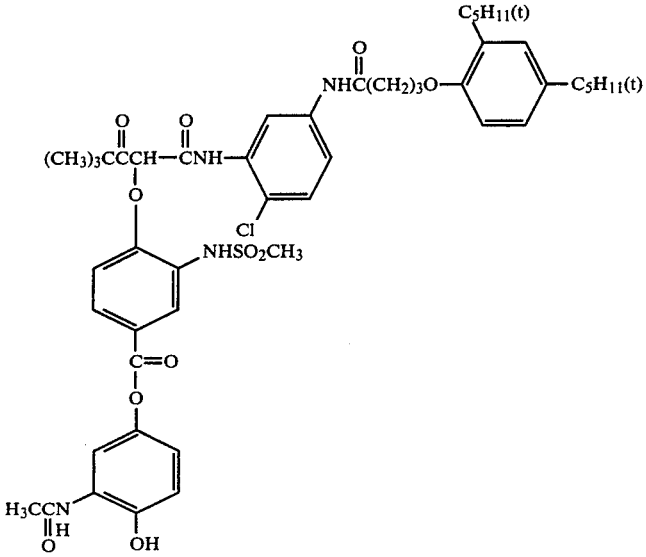

(26)

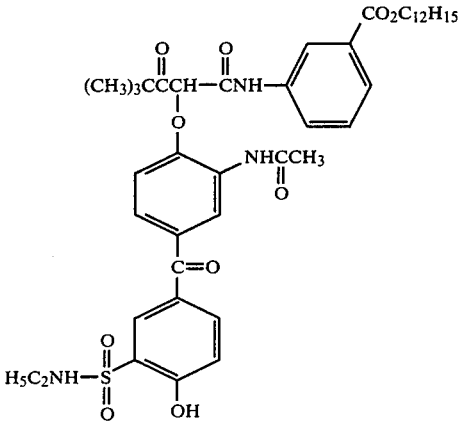

The couplers according to the present invention can be synthesized by combinations of known methods. For example, an acylacetamide type coupler having an aryloxy group as a group capable of being released can be synthesized by halogenating the coupling position of a 4-equivalent coupler and reacting with a phenol compound in the presence of a base. An oxygen-ether releasing type coupler of a 5-pyrazolone type coupler, a phenol type coupler, a naphthol type coupler and a part of an acylacetamide type coupler can be synthesized by reacting a compound prepared by introducing a hydroxy group to the coupling position of a 4-equivalent coupler with an active halogenated compound in the presence of a base. A thioether releasing type coupler can generally be synthesized by reacting a 4-equivalent coupler with a sulfonyl chloride to form a group capable of being released in the presence of or without a base. These methods of synthesizing 2-equivalent couplers are described in known literature, for example, U.S. Pat. Nos. 3,894,875, 3,933,501, 4,296,199, 3,227,554, 3,476,563, 4,296,200, 4,234,678, 4,228,233, 4,351,897, 4,264,723, 4,366,237 and 3,408,194, Japanese Patent Application (OPI) Nos. 70871/72, 96343/72 and 52423/73, etc.

In a route for synthesizing the couplers according to the present invention, a method in which a group capable of being released is introduced after formation of a coupler skeleton is generally employed advantageously. However, a method can be used in which at first a 2-equivalent coupling group of a coupler is synthesized, an active functional group such as an amino group, etc., is formed by reduction or other appropriate procedures and then a diffusion-resistant group is introduced thereto.

Typical examples of synthesizing the coupler according to the present invention are specifically set forth below.

SYNTHESIS EXAMPLE 1

Synthesis of Coupler (1)

44 g of α-chloro-α-pivaloyl-2-chloro-5-(n-hexadecansulfonamido)acetanilide and 112 g of 3,3'-dichloro-4,4'-dihydroxydiphenylsulfone were dissolved under refluxing in a mixture of 240 ml of dimethylacetamide and 210 ml of acetonitrile. To the solution was gradually added dropwise 9.7 ml of triethylamine and then the mixture was reacted under refluxing for 5 hours. The reaction mixture was poured into 500 ml of a 5% aqueous solution of sodium hydroxide and extracted with 300 ml of ethyl acetate. The oil phase was washed twice with water, dried with magnesium sulfate and concentrated under reduced pressure to obtain 60 g of a residue. The residue was separated by silica gel chromatography, a portion containing the desired product thus obtained was concentrated under reduced pressure and the residue was crystallized from a solvent mixture of n-hexane and ethanol (ratio by volume 10/1) to obtain 45 g of Coupler (1). Melting Point: 91° to 96° C.

SYNTHESIS EXAMPLE 2

Synthesis of Coupler (2)

33 g of α-chloro-α-pivaloyl-2-chloro-5-(n-dodecyloxycarbonyl)acetanilide and 112 g of 3,3'-dichloro-4,4'-dihydroxyphenylsulfone were dissolved under refluxing in a mixture of 300 ml of dimethylacetamide and 150 ml of acetonitrile. To the solution was added dropwise 15 ml of triethylamine and then the mixture was reacted under refluxing for 3 hours. The reaction mixture was poured into 500 ml of a 5% aqueous solution of sodium hydroxide and extracted with 300 ml of ethyl acetate. The oil phase was washed three times with water, dried with magnesium sulfate and concentrated under reduced pressure to obtain 58 g of a residue. The residue was separated by silica gel chromatography, a portion containing the desired product thus-obtained was concentrated under pressure and the residue was crystallized from a solvent mixture of n-hexane and isopropanol to obtain 38 g of Coupler (2). Melting Point: 88° to 92° C.

In the following the amount of couplers to be used and compositions other than the coupler according to the present invention in the color photographic light-sensitive material of the present invention are described.

The amount of the coupler according to the present invention and other couplers used is not particularly restricted, but it is preferably from $2\times10^{-3}$ mole to $5\times10^{-1}$ mole, and particularly preferably from $1\times10^{-2}$ mole to $5\times10^{-1}$ mole, per mole of silver in a silver halide emulsion layer.

Conventional methods, e.g., the method described in U.S. Pat. No. 2,322,027, can be employed to incorporate the coupler into the silver halide emulsion layer. For example, the coupler can be dissolved either in an organic solvent having a high boiling point such as phthalic acid alkyl esters (e.g., dibutyl phthalate, dioctyl phthalate, etc.), phosphoric acid esters (e.g., diphenyl phosphate, triphenyl phosphate, tricresyl phosphate, dioctylbutyl phosphate, etc.), citric acid esters (e.g., tributyl acetylcitrate, etc.), benzoic acid esters (e.g., octyl benzoate, etc.), alkyl amides (e.g., diethyl laurylamide, etc.), fatty acid esters (e.g., dibutoxyethyl succinate, etc.), trimesic acid esters, etc.; or an organic solvent having a low boiling point of from about 30° to 150° C. such as a lower alkyl acetate (e.g., ethyl acetate, butyl acetate, etc.), ethyl propionate, sec-butyl alcohol, methyl isobutyl ketone, β-ethoxyethyl acetate, methyl Cellosolve acetate, etc., and then the solution is dispersed in a hydrophilic colloid. The above-described organic solvents having a high boiling point and the above-described organic solvents having a low boiling point may be used as mixtures, if desired.

Known open chain ketomethylene type couplers can be used as yellow color forming couplers. Of these couplers, benzoyl acetanilide type and pivaloyl acetanilide type compounds are advantageous. Specific examples of yellow color forming couplers which can be employed as described, for example, in U.S. Pat. Nos. 2,875,057, 3,265,506, 3,408,194, 3,551,155, 3,582,322, 3,725,072, 4,356,258 and 3,891,445, West German Pat. No. 1,547,868, West German Patent Application (OLS) Nos. 2,219,917, 2,261,361 and 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 82424/77 and 115219/77, etc.

Pyrazolone type compounds, indazolone type compounds, cyanoacetyl type compounds, etc., can be used as magenta color forming couplers, and pyrazolone type compounds are particularly advantageous. Specific examples of magenta color forming couplers which can be employed are those described, for example, in U.S. Pat. Nos. 2,600,788, 2,983,608, 3,062,653, 3,127,269, 3,311,476, 3,419,391, 3,519,429, 3,558,319, 3,582,322, 3,615,506, 3,834,908, 3,891,445, 4,367,282, 4,366,237, 4,351,897, 4,388,393 and 4,241,168, West German Pat. No. 1,810,464, West German Patent Application (OLS) Nos. 2,408,665, 2,417,945, 2,418,959 and 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76 and 55122/78, etc.

Phenol type compounds, naphthol type compounds, etc., can be employed as cyan color forming couplers. Specific examples of cyan color forming couplers which can be employed are those described, for example, in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, 4,004,929, 4,362,810, 4,368,257, 4,341,864, 4,333,999, 4,342,825 and 4,345,025, West German Patent Application (OLS) Nos. 2,414,830 and 2,454,329, Japanese Patent Application (OPI) Nos. 59838/73, 26034/76, 5055/83, 146828/76, 69624/77 and 90932/77, etc.

Colored couplers which can be employed are described, for example, in U.S. Pat. Nos. 3,476,560, 2,521,908 and 3,034,892, Japanese Patent Publication Nos. 2016/69, 22335/63, 11304/67 and 32461/69, Japanese Patent Application (OPI) Nos. 26034/76 and 42121/77, West German Patent Application (OLS) No. 2,418,959, etc.

Development inhibitor releasing (DIR) couplers which can be employed are described, for example, in U.S. Pat. Nos. 3,227,554, 3,617,291, 3,701,783, 3,790,384, 3,632,345, 4,355,100 and 4,248,962, West German Patent Application (OLS) Nos. 2,414,006, 2,454,301, 2,454,329, and 3,209,486, British Pat. No. 953,454, Japanese Patent Application (OPI) Nos. 69624/77, 122335/74, Japanese Patent Publication No. 16141/76, etc.

In addition to DIR couplers, other compounds which release development inhibitors upon development can also be present in the photographic light-sensitive material. For example, DIR compounds as described, for example, in U.S. Pat. Nos. 3,297,445 and 3,379,529, West German Patent Application (OLS) No. 2,417,914, Japanese Patent Application (OPI) Nos. 15271/77 and 9116/78, etc., can be employed.

Two or more kinds of the couplers described above can be incorporated in the same layer, or the same coupler compound can be present in two or more layers. These couplers are incorporated into the emulsion layer, generally in an amount of from $2\times10^{-3}$ mole to $5\times10^{-1}$ mole, preferably $1\times10^{-2}$ mole to $5\times10^{-1}$ mole, per mole of silver.

The hydrophilic colloid layers of the photographic light-sensitive materials prepared in accordance with the present invention can contain ultraviolet ray absorbing agents. For example, benzotriazole compounds substituted with an aryl group (e.g., those described in U.S. Pat. No. 3,533,794), 4-thiazolidone compounds (e.g., those described in U.S. Pat. Nos. 3,314,794 and 3,352,681), benzophenone compounds (e.g., those described in Japanese Patent Application (OPI) No. 2784/71), cinnamic acid ester compounds (e.g., those described in U.S. Pat. Nos. 3,705,805 and 3,707,375), butadiene compounds (e.g., those described in U.S. Pat. No. 4,045,229) or benzoxazole compounds (e.g., those described in U.S. Pat. No. 3,700,455) can be employed. Furthermore, the compounds as described in U.S. Pat. No. 3,499,762, Japanese Patent Application (OPI) No. 48535/79 can also be used. Ultraviolet ray absorbing couplers (e.g., α-naphthol type cyan dye forming couplers) and ultraviolet ray absorbing polymers can also be employed. These ultraviolet ray absorbing agents can be mordanted in a specific layer(s), if desired.

The photographic emulsion used in the present invention can be prepared using the methods described in, e.g., P. Glafkides, *Chimie et Physique Photographique,* Paul Montel (1967), G. F. Duffin, *Photographic Emulsion Chemistry,* The Focal Press (1966), V. L. Zelikman, et al., *Making and Coating Photographic Emulsions,* The Focal Press (1964), etc. That is, any of the acid method, the neutral method and the ammonia method, etc., can be used. Moreover, a soluble silver salt can be reacted with a soluble halogen salt using any of the single jet method, the double jet method, and a combination thereof.

A method in which grains are formed in the presence of an excess of silver ions (i.e., the so-called reverse mixing method) can also be used. As one of the modes of the double jet method, the method in which the pAg of the liquid phase in which the silver halide is to be produced is kept constant, that is, the so-called controlled double jet method, can be used. This method can provide silver halide emulsions having a regular crystal form and an almost uniform grain size.

Two or more silver halide emulsions which are separately prepared can be mixed and then used, if desired.

In the process of the formation of the silver halide grains or physical ripening thereof, cadmium salts, zinc salts, lead salts, thallium salts, iridium salts or complex salts thereof, rhodium salts or complex salts thereof, iron salts or iron complex salts, etc., can be present.

Gelatin can advantageously be used as the binder or protective colloid for the photographic emulsion used in the present invention. However, other hydrophilic colloids can be used as well. For example, proteins such as gelatin derivatives, graft polymers between gelatin and other polymers, albumin, casein, etc.; cellulose derivatives such as hydroxyethyl cellulose, carboxymethyl cellulose, cellulose sulfates, etc.; saccharide derivatives such as sodium alginate, starch derivatives, etc.; and various synthetic hydrophilic polymers of homo- or copolymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc., can be used as the binder or protective colloid for the photographic emulsion.

Acid-processed gelatin and enzyme-processed gelatin as described in *Bull. Soc. Sci. Photo. Japan,* No. 16, page 30 (1966) can be used as well as lime-processed gelatin, as the gelatin. In addition, the hydrolyzed products of gelatin and enzyme-decomposed products of gelatin are also suitable. Suitable gelatin derivatives which can be used include those obtained by reacting gelatin with various compounds, such as acid halides, acid anhydrides, isocyanates, bromoacetic acid, alkanesultones, vinylsulfonamides, maleinimide compounds, polyalkylene oxides, epoxy compounds, etc. Specific examples thereof are described in U.S. Pat. Nos. 2,614,928, 3,132,945, 3,186,846 and 3,312,553, British Pat. Nos. 861,414, 1,033,189 and 1,005,784, Japanese Patent Publication No. 26845/67, etc.

As the above-described gelatin graft polymer, those which are obtained by grafting homo- or copolymers of vinyl monomers such as acrylic acid, methacrylic acid, the ester or amide derivatives thereof, acrylonitrile, styrene, etc., to gelatin can be used. In particular, graft polymers with a polymer having some compatibility with gelatin, such as polymers of acrylic acid, methacrylic acid, acrylamide, methacrylamide, hydroxyalkyl methacrylates, etc., are preferred. Examples thereof are described in U.S. Pat. Nos. 2,763,625, 2,831,767 and 2,956,884, etc.

Typical synthetic hydrophilic polymer materials are described in, for example, West German Patent Application (OLS) No. 2,312,708, U.S. Pat. Nos. 3,620,751 and 3,879,205 and Japanese Patent Publication No. 7561/68, etc.

For the purposes of preventing fog or stabilizing the photographic properties during preparation, storage, and/or photographic processing of the photographic light-sensitive material, a variety of compounds can be incorporated into photographic emulsions used according to the present invention. For example, a wide variety of compounds which are known as antifogging agents or stabilizers, such as azoles, e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole), etc.; mercaptopyrimidines; mercaptotriazines; thioketo compounds, such as oxazolinethione; azaindenes, e.g., triazaindenes, tetraazaindenes (especially 4-hydroxy-substituted (1,3,3a,7)tetraazaindenes), pentaazaindenes, etc.; benzenethiosulfonic acid, benzenesulfinic acid, benzenesulfonic acid amide, etc., can be used. For example, the compounds as described in U.S. Pat. Nos. 3,954,474 and 3,982,947, Japanese Patent Publication No. 28660/77 can be used.

For the purpose of increasing sensitivity, increasing contrast, or accelerating development, the photographic emulsion layer of the photographic light-sensitive material according to the present invention can contain other known additives, such as, for example, polyalkylene oxides or derivatives thereof such as ethers, esters, amines, etc., thioether compounds, thiomorpholine compounds, quaternary ammonium compounds, urethane derivatives, urea derivatives, imidazole derivatives, 8-pyrazolidones; etc. For example, such additives as described in U.S. Pat. Nos. 2,400,532, 2,423,549, 2,716,062, 3,617,280, 3,772,021 and 3,808,003, British Pat. No. 1,488,991, etc., can be employed.

The photographic emulsion used in the present invention can also be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, is applicable to these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei, nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei can also be substituted.

The merocyanine dyes and the complex merocyanine dyes that can be employed contain 5- or 6-membered heterocyclic nuclei such as a pyrazolin-5-one nucleus, a thiohydantoin nucleus, a 2-thioxazolidin-2,4-dione nucleus, a thiazolidin-2,4-dione nucleus, a rhodanine nucleus, a thiobarbituric acid nucleus, etc., as a nucleus having a ketomethylene structure.

Useful sensitizing dyes include those described in German Pat. No. 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Pat. No. 1,242,588, Japanese Patent Publication Nos. 14030/69 and 24844/77, etc.

These sensitizing dyes can be employed individually, and can also be employed in combination. A combination of sensitizing dyes is often used particularly for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, and Japanese Patent Application (OPI) Nos. 110618/77 and 109925/77, etc.

The sensitizing dyes may be present in the emulsion together with dyes which themselves do not give rise to sepctrally sensitizing effects, but rather exhibit a supersensitizing effect, or materials which do not substantially absorb visible light, but rather exhibit a supersensitizing effect. For example, aminostilbene compounds substituted with a nitrogen-containing heterocyclic group (e.g., as described in U.S. Pat. Nos. 2,933,390 and 3,635,721), aromatic organic acid-formaldehyde condensates (e.g., as described in U.S. Pat. No. 3,743,510), cadmium salts, azaindene compounds, etc., can be present. The combinations as described in U.S. Pat. Nos. 3,615,613, 3,615,641, 3,617,295 and 3,635,721 are particularly useful.

The hydrophilic colloid layers of the photographic light-sensitive material prepared according to the present invention can contain water-soluble dyes such as filter dyes or for purpose of preventing irradiation or other various purposes. Such dyes include oxonol dyes, hemioxonol dyes, styryl dyes, merocyanine dyes, cyanine dyes, and azo dyes. Of these dyes, oxonol dyes, hemioxonol dyes and merocyanine dyes are especially useful. Specific examples of such dyes which can be employed are described, for example, in British Pat. Nos. 584,609 and 1,177,429, Japanese Patent Application (OPI) Nos. 85130/73, 99620/74, 114420/74 and 108115/77, and U.S. Pat. Nos. 2,274,782, 2,533,472, 2,956,879, 3,148,186, 3,177,078, 3,247,127, 3,540,887, 3,575,704, 3,653,905, 3,718,472, 4,071,312 and 4,070,352, etc.

The photographic emulsion layers and other hydrophilic colloid layers of the photographic light-sensitive material prepared in accordance with the present invention can contain whitening agents, such as stilbenes, triazines, oxazoles, or coumarins, etc. These agents can be water-soluble or can also be employed as a dispersion of water-insoluble whitening agents. Specific examples of fluorescent whitening agents are described in U.S. Pat. Nos. 2,632,701, 3,169,840 and 3,359,102, and British Pat. Nos. 852,075 and 1,319,763, etc.

In the practice of the present invention, known color fading preventing agents as described below can be employed. These dye image stabilizers can be used individually or in a combination of two or more thereof. Specific examples of known color fading preventing agents include, for example, hydroquinone derivatives as described in U.S. Pat. Nos. 2,360,290, 2,418,613, 2,675,314, 3,701,197, 2,704,713, 2,728,659, 2,732,300, 2,735,765, 2,710,801 and 2,816,028, British Pat. No. 1,363,921; gallic acid derivatives as described in U.S. Pat. Nos. 3,457,079 and 3,069,262; p-alkoxyphenols as described in U.S. Pat. Nos. 2,735,765 and 3,698,909, Japanese Patent Publication Nos. 20977/74 and 6623/77; p-oxyphenol derivatives as described in U.S. Pat. Nos. 3,432,300, 3,573,050, 3,574,627 and 3,764,337, Japanese Patent Application (OPI) Nos. 35633/77, 147434/77 and 152225/77; bisphenols as described in U.S. Pat. No. 3,700,455, etc.

The photographic light-sensitive materials prepared according to the present invention can also contain, as color fog preventing agents, hydroquinone derivatives, aminophenol derivatives, agllic acid derivatives, ascorbic acid derivatives, etc. Specific examples of these agents are described in U.S. Pat. Nos. 2,360,290, 2,336,327, 2,403,721, 2,418,613, 2,675,314, 2,701,197, 2,704,713, 2,728,659, 2,732,300 and 2,735,765, Japanese Patent Application (OPI) Nos. 92988/75, 92989/75, 93928/75, 110337/75 and 146235/77, Japanese Patent Publication No. 23813/75, etc.

The present invention is also applicable to a multilayer multicolor photographic material containing layers sensitive to at least two different spectral wavelength ranges on a support. A multilayer natural color photographic material generally possesses at least one red-sensitive silver halide emulsion layer, at least one green-sensitive silver halide emulsion layer, and at least one blue-sensitive silver halide emulsion layer, respectively, on a support. The order of these layers can be varied, if desired. Ordinarily, a cyan forming coupler is present in a red-sensitive emulsion layer, a magenta forming coupler is present in a green-sensitive emulsion layer, and a yellow forming coupler is present in a blue-sensitive emulsion layer, respectively. However, if desired, a different combination can be employed.

Known methods can be used for processing the photographic light-sensitive material according to the present invention. Known processing solutions can be used. The processing temperature can be from 18° C. to 50° C., in general, but temperatures lower than about 18° C. or higher than about 50° C. may be used, if desired. Depending on purposes, either a development processing for forming silver images (black-and-white photographic processing) or a color photographic processing comprising developing processing for forming dye images can be employed.

The color developing solution generally comprises an alkaline aqueous solution containing a color developing agent. Suitable color developing agents which can be employed include known primary aromatic amine developing agents, e.g., phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfamidoethylaniline, 4-amino-3-methyl-N-ethyl-N-β-methoxyethylaniline, etc.).

In addition, developing agents as described in L. F. A. Mason, *Photographic Processing Chemistry,* pages 226 to 229, Focal Press (1966), U.S. Pat. Nos. 2,193,105 and 2,592,364, Japanese Patent Application (OPI) No. 64933/73, etc., can be employed.

The color developing solution can also contain pH buffering agents, such as sulfites, carbonates, borates and phosphates of alkali metals, development inhibitors or antifogging agents such as bromides, iodides or organic antifogging agents, etc. In addition, if desired, the color developing solution can also contain water softeners, preservatives such as hydroxylamine; organic solvents such as benzyl alcohol, diethylene glycol, etc.; developing accelerators such as polyethylene glycol, quaternary ammonium salts, amines; dye forming couplers; competitive couplers; fogging agents such as sodium borohydride; auxiliary developing agents such as 1-phenyl-3-pyrazolidone; viscosity-imparting agents; polycarboxylic acid type chelating agents as described in U.S. Pat. No. 4,083,723; antioxidizing agents as described in West German Patent Application (OLS) No. 2,622,950, etc.

The photographic emulsion layers after color development are generally subjected to bleach processing. Bleach processing can be performed at the same time as fix processing, or separately therefrom. Suitable bleaching agents which can be employed are compounds of polyvalent metals such as iron (III), cobalt (III), chromium (VI), copper (II), etc., peracids, quinones, nitroso compounds, etc. Specific examples include ferricyanides; bichromates; organic complexes of iron (III) or cobalt (III) with aminopolycarboxylic acids such as ethylenediaminetetraacetic acid, nitrilotriacetic acid, 1,3-diamino-2-propanol tetraacetic acid, etc., or organic acids such as citric acid, tartaric acid, malic acid, etc.; persulfates; permanganates; nitrosophenol; etc. Of these, particularly useful bleaching agents are potassium ferricyanide, sodium ethylenediaminetetraacetato iron (III) and ammonium ethylenediaminetetraacetato iron (III). Ethylenediaminetetraacetato iron (III) complex is useful both in a bleaching solution and in a mono-bath bleach-fixing solution.

Bleaching solutions and bleach-fixing solutions can contain various additives, including bleach accelerating agents as described in U.S. Pat. Nos. 3,042,520 and 3,241,966, Japanese Patent Publication Nos. 8506/70 and 8836/70, thiol compounds as described in Japanese Patent Application (OPI) No. 65732/78, etc.

The present invention will be explained in greater detail with reference to the following examples, but the present invention should not be construed as being limited thereto.

EXAMPLE 1

10 g of Coupler (1) according to the present invention was dissolved by heating in a mixture of 5 ml of dibutyl phthalate and 10 ml of ethyl acetate and the resulting solution was mixed with 100 ml of a 10% aqueous solution of gelatin containing 0.1 g of sodium dodecylbenzenesulfonate. The mixture was stirred at 50° C. using a homogenizer rotating with high speed to obtain a coupler dispersion. The dispersion was mixed with 150 g of a silver chlorobromide emulsion, to which were added 15 ml of a 2% aqueous solution of 2-hydroxy-4,6-dichloro-s-triazine sodium salt and 6 ml of a 5% aqueous solution of saponin, and the resulting mixture was coated on a cellulose acetate film in a silver coated amount of 1 g/m$^2$. On the emulsion layer a gelatin protective layer was coated at a dry thickness of 1μ to prepare Sample A. Further, Samples B to R were prepared in the same manner as described in Sample A except using the couplers as shown in Table 1 below, respectively, in place of Coupler (1) and adjusting the coated molar amount of coupler and a coated amount of silver to those in Sample A.

Samples A to R were exposed stepwise to light for sensitometry and then subjected to the following development processing.

| Step | Temperature (°C.) | Time |
|---|---|---|
| Color Development | 38 | 3 min |
| Washing with Water | 38 | 1 min |
| Bleach-Fixing | 38 | 1 min 30 sec |
| Washing with Water | 38 | 1 min |

The compositions of the color developing solutions were as follows.

| | CD-1 | CD-2 | CD-3 |
|---|---|---|---|
| Benzyl Alcohol | — | — | 15 ml |
| Diethylene Glycol | — | — | 8 ml |
| Developing Agent | A*: 3.5 g | B*: 5 g | B*: 5 g |
| Sodium Sulfite | 2 g | 2 g | 2 g |
| Hydroxylamine Sulfate | 3 g | 3 g | 3 g |
| Potassium Carbonate | 30 g | 30 g | 30 g |
| Water to make | 1 l | 1 l | 1 l |
| pH (adjusted to) | 10.2 | 10.2 | 10.2 |

A*: 4-Amino-3-methyl-N—ethyl-N—β-hydroxyethylaniline Sulfate
B*: 4-Amino-3-methyl-N—ethyl-N—β-(methanesulfonamido)-ethylaniline Sulfate The composition of the bleach-fixing solution was as follows.

| | |
|---|---|
| Disodium Ethylenediaminetetraacetate | 2 g |
| Ferric Ethylenediaminetetraacetate | 40 g |
| Sodium Sulfite | 5 g |
| Ammonium Thiosulfate | 70 g |
| Water to make | 1 l |
| | pH was adjusted to 6.8 |

The transmittance of each sample thus-processed was measured (yellow, magenta or cyan density was measured depending on the dye formed) and the maximum density ($D_{max}$) and gamma ($\gamma$) were determined. The results obtained are shown in Table 1 below.

TABLE 1

| | | CD-1 | | CD-2 | | CD-3 | |
|---|---|---|---|---|---|---|---|
| Sample | Coupler | $D_{max}$ | $\gamma$ | $D_{max}$ | $\gamma$ | $D_{max}$ | $\gamma$ |
| A | Coupler (1) (Present Invention) | 3.37 | 2.31 | 3.13 | 2.14 | 3.21 | 2.28 |
| B | Coupler (2) (Present Invention) | 3.24 | 2.14 | 3.08 | 2.08 | 3.20 | 2.16 |
| C | Coupler (8) (Present Invention) | 3.18 | 2.21 | 3.05 | 2.01 | 3.14 | 2.20 |
| D | YR-1 (Comparison) | 3.01 | 1.98 | 2.64 | 1.56 | 2.89 | 1.95 |
| E | YR-2 (Comparison) | 2.80 | 1.44 | 2.15 | 1.20 | 2.81 | 1.56 |
| F | YR-3 (Comparison) | 3.06 | 2.07 | 2.87 | 1.90 | 3.00 | 2.04 |
| G | Coupler (12) (Present Invention) | 3.85 | 2.63 | 3.62 | 2.67 | 3.83 | 2.62 |
| H | Coupler (13) (Present Invention) | 3.52 | 2.56 | 3.34 | 2.52 | 3.54 | 2.50 |
| I | Coupler (15) (Present Invention) | 3.40 | 2.51 | 3.21 | 2.40 | 3.43 | 2.54 |
| J | MR-1 (Comparison) | 2.94 | 2.03 | 2.77 | 1.92 | 3.15 | 2.12 |
| K | MR-2 (Comparison) | 3.04 | 2.09 | 2.88 | 1.94 | 3.00 | 2.10 |
| L | MR-3 (Comparison) | 3.15 | 2.17 | 3.06 | 2.00 | 3.21 | 2.14 |
| M | Coupler (17) (Present Invention) | 3.50 | 2.51 | 3.39 | 2.56 | 3.52 | 2.56 |
| N | Coupler (18) (Present Invention) | 3.47 | 2.58 | 3.42 | 2.54 | 3.42 | 2.54 |
| O | Coupler (19) (Present Invention) | 3.38 | 2.51 | 3.35 | 2.50 | 2.41 | 2.53 |
| P | CR-1 (Comparison) | 2.80 | 1.87 | 2.24 | 1.44 | 2.79 | 1.90 |
| Q | CR-2 (Comparison) | 2.66 | 1.50 | 2.13 | 1.27 | 2.68 | 1.52 |
| R | CR-3 (Comparison) | 3.00 | 2.00 | 2.83 | 1.91 | 3.12 | 2.12 |

Comparison Couplers

YR-1

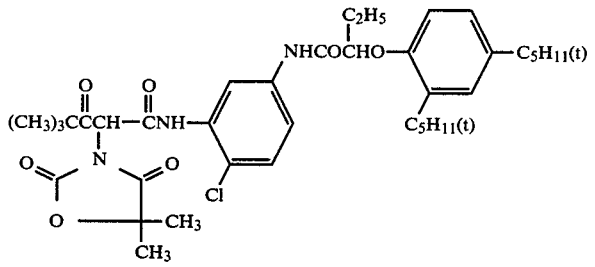

YR-2

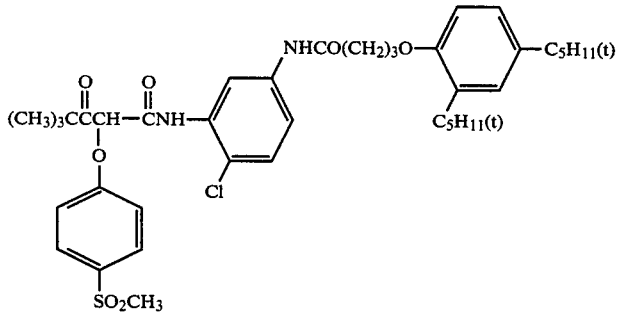

YR-3

TABLE 1-continued
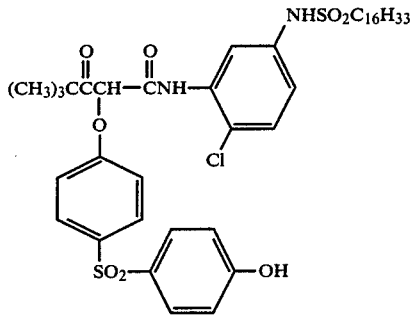
MR-1
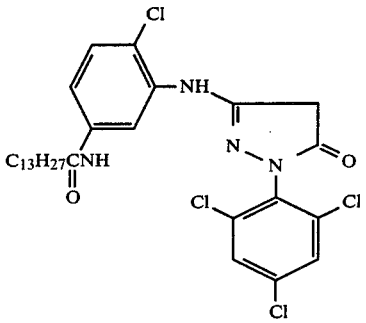
MR-2
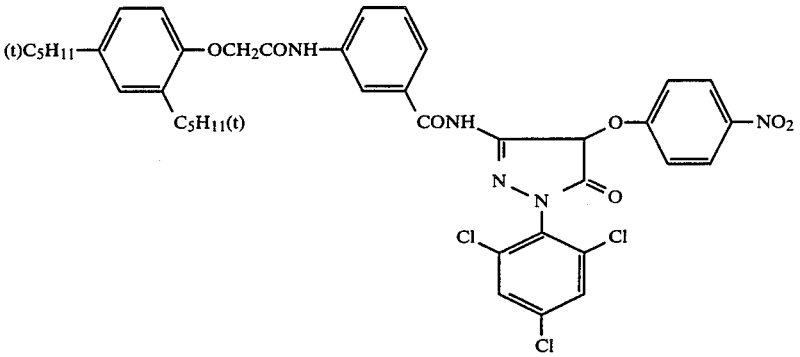
MR-3
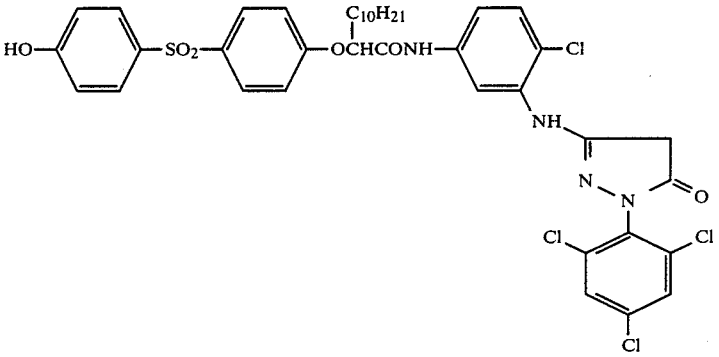
CR-1

TABLE 1-continued

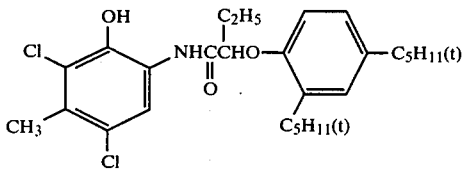

CR-2

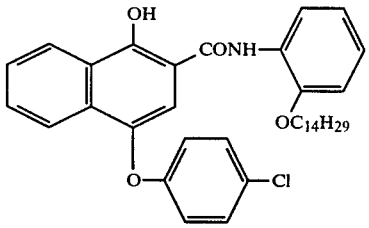

CR-3

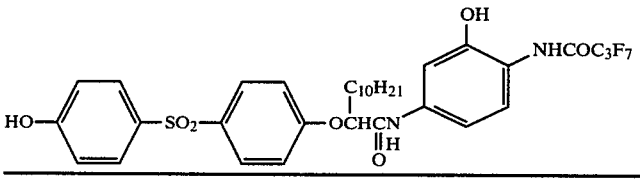

From the results shown in Table 1 above it is apparent that Samples A to C, G to I and M to O containing the coupler according to the present invention exhibit excellent color forming properties although $D_{max}$ and $\gamma$ are low and thus inferior color forming properties are obtained in Samples D to F, J to L and P to R for comparison. In particular, when the results obtained with CD-2 and those obtained with CD-3, both of which contain the common color developing agent B having a relatively high activity are compared, the comparison samples exhibit remarkable decrease in color forming properties with CD-2 which does not contain benzyl alcohol. On the contrary, in the samples according to the present invention the differences of the results between CD-2 and CD-3 are small and they provide sufficiently high color densities without using benzyl alcohol.

EXAMPLE 2

On a paper support both surfaces of which were laminated with polyethylene were coated a first layer (undermost layer) to a sixth layer (uppermost layer) as shown in Table 2 below in order to prepare color photographic light-sensitive materials which are designated Samples A to C.

A coating solution for the first layer was prepared in the following manner. That is, 100 g of the yellow coupler shown in Table 2 below was dissolved in a mixture of 166.7 ml of dibutyl phthalate (DBP) and 200 ml of ethyl acetate and the resulting solution was dispersed in 800 g of a 10% aqueous solution of gelatin containing 80 ml of a 1% aqueous solution of sodium dodecylbenzenesulfonate. The dispersion was mixed with 1,450 g of a blue-sensitive silver chlorobromide emulsion (containing 66.7 g of silver and having a bromide content of 80% by mole) to prepare a coating solution. Coating solutions for other layers were prepared in a similar manner. In each layer 2,4-dichloro-6-hydroxy-s-triazine sodium salt was used as a hardener.

The following spectral sensitizing dyes were employed in the emulsion layers, respectively.

Blue-Sensitive Emulsion Layer:

Sodium salt of 3,3'-di($\gamma$-sulfopropyl)selenacyanine: $2\times10^{-4}$ mole per mole of silver halide Green-Sensitive Emulsion Layer:

Sodium salt of 3,3'-di($\gamma$-sulfopropyl)-5,5'-diphenyl-9-ethyloxacarbocyanine: $2.5\times10^{-4}$ mole per mole of silver halide Red-Sensitive Emulsion Layer:

Sodium salt of 3,3'-di($\gamma$-sulfopropyl)-9-methylthiadicarbocyanine: $2.5\times10^{-4}$ mole per mole of silver halide The following dyes were employed as irradiation preventing dyes in the emulsion layers, respectively.

Green-Sensitive Emulsion Layer:

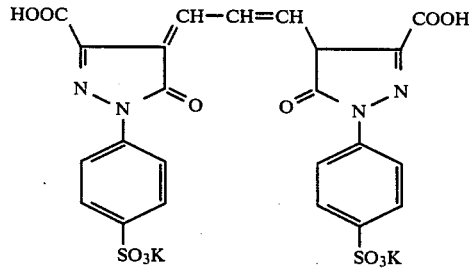

Red-Sensitive Emulsion Layer:

-continued

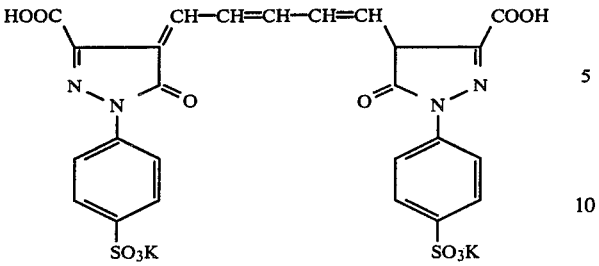

TABLE 2

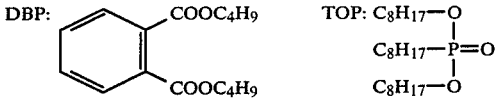

| | Sample | A | B | C |
|---|---|---|---|---|
| Sixth Layer: (protective layer) | Gelatin Coating amount | 1,500 mg/m$^2$ | 1,500 mg/m$^2$ | 1,500 mg/m$^2$ |
| Fifth Layer: (red-sensitive layer) | Silver chlorobromide emulsion (silver bromide: 50 mole %) | | | |
| | Coating amount of silver | 300 mg/m$^2$ | 300 mg/m$^2$ | 300 mg/m$^2$ |
| | Cyan coupler (coating amount) | CR-1 (Comparison) (400 mg/m$^2$) | Coupler (17) (Present Invention) (570 mg/m$^2$) | Coupler (18) (Present Invention) (640 mg/m$^2$) |
| | Solvent (coating amount) | DBP (240 mg/m$^2$) | DBP (340 mg/m$^2$) | DBP (380 mg/m$^2$) |
| Fourth Layer: (ultraviolet ray absorbing layer) | Gelatin Coating amount | 2,000 mg/m$^2$ | 2,000 mg/m$^2$ | 2,000 mg/m$^2$ |
| | Ultraviolet ray absorbing agent (coating amount) | UV-1 (15 mg/m$^2$) UV-2 (45 mg/m$^2$) UV-3 (90 mg/m$^2$) | UV-1 (15 mg/m$^2$) UV-2 (45 mg/m$^2$) UV-3 (90 mg/m$^2$) | UV-1 (15 mg/m$^2$) UV-2 (45 mg/m$^2$) UV-3 (90 mg/m$^2$) |
| | Solvent (coating amount) | DBP (60 mg/m$^2$) | DBP (60 mg/m$^2$) | DBP (60 mg/m$^2$) |
| Third Layer: (green-sensitive layer) | Silver chlorobromide emulsion (silver bromide: 70 mole %) | | | |
| | Coating amount of silver | 450 mg/m$^2$ | 450 mg/m$^2$ | 450 mg/m$^2$ |
| | Magenta coupler (coating amount) | MR-1 (Comparison) (350 mg/m$^2$) | Coupler (12) (Present Invention) (490 mg/m$^2$) | Coupler (13) (Present Invention) (450 mg/m$^2$) |
| | Solvent (coating amount) | TOP (440 mg/m$^2$) | TOP (620 mg/m$^2$) | TOP (590 mg/m$^2$) |
| Second Layer: (intermediate layer) | Gelatin Coating amount | 1,500 mg/m$^2$ | 1,500 mg/m$^2$ | 1,500 mg/m$^2$ |
| First Layer: (blue-sensitive layer) | Silver chlorobromide emulsion (silver bromide: 80 mole %) | | | |
| | Coating amount of silver | 1,500 mg/m$^2$ | 1,500 mg/m$^2$ | 1,500 mg/m$^2$ |
| | Yellow coupler (coating amount) | YR-1 (comparison) (600 mg/m$^2$) | Coupler (1) (Present Invention) (730 mg/m$^2$) | Coupler (2) (Present Invention) (590 mg/m$^2$) |
| | Solvent (coating amount) | DBP (1,000 mg/m$^2$) | DBP (1,220 mg/m$^2$) | DBP (980 mg/m$^2$) |
| Support | Paper support both surfaces of which were laminated with polyethylene | | | |

The chemical structures of the solvents set forth in Table 2 are as follows:

Each sample was exposed stepwise to light for sensitometry and then subjected to the same development processing as described in Example 1 with CD-2 and CD-3 employed as color developing solutions. The reflective densities of each sample thus-processed were measured (with red light, green light and blue light) and the fog, maximum density ($D_{max}$) and gamma ($\gamma$) were determined. The results obtained are shown in Table 3 below.

TABLE 3

| | CD-2 | | | | | | | | | CD-3 | | | | | | | | |
|---|---|---|---|---|---|---|---|---|---|---|---|---|---|---|---|---|---|---|
| | Cyan | | | Magenta | | | Yellow | | | Cyan | | | Magenta | | | Yellow | | |
| Sample | Fog | $\gamma$ | $D_{max}$ | Fog | $\gamma$ | $D_{max}$ | Fog | $\gamma$ | $D_{max}$ | Fog | $\gamma$ | $D_{max}$ | Fog | $\gamma$ | $D_{max}$ | Fog | $\gamma$ | $D_{max}$ |
| A | 0.08 | 2.68 | 3.12 | 0.07 | 2.81 | 2.22 | 0.09 | 2.79 | 2.14 | 0.10 | 3.21 | 2.51 | 0.08 | 3.37 | 2.71 | 0.12 | 3.10 | 2.68 |
| B | 0.08 | 3.25 | 2.53 | 0.07 | 3.39 | 2.73 | 0.09 | 3.37 | 2.69 | 0.10 | 3.40 | 2.71 | 0.08 | 3.46 | 2.89 | 0.12 | 3.41 | 2.89 |
| C | 0.08 | 3.41 | 2.70 | 0.07 | 3.37 | 2.68 | 0.09 | 3.39 | 2.70 | 0.10 | 3.43 | 2.77 | 0.08 | 3.43 | 2.80 | 0.12 | 3.42 | 2.77 |

From the results shown in Table 3 above it is apparent that Samples B and C according to the present invention provide excellent color forming properties using CD-2, although in Sample A for comparison, $\gamma$ and $D_{max}$ are remarkably decreased when CD-2 which is a color developing solution that does not contain benzyl alcohol.

UV-1, UV-2 and UV-3 shown in Table 2 above are the compounds having the following structures, respectively.

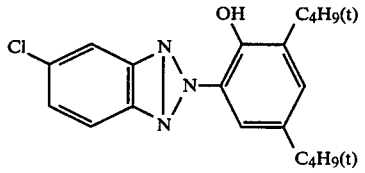

UV-1

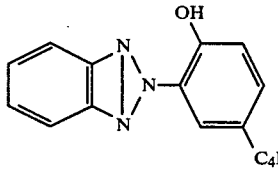

UV-2

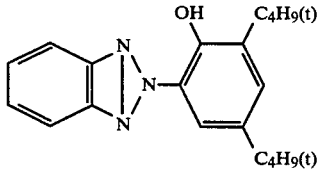

UV-3

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having thereon at least one silver halide emulsion layer, the color photographic light-sensitive material containing a coupler having at the coupling position thereof a group represented by formula (I)

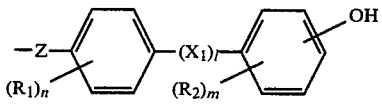

(I)

wherein Z represents an oxygen atom or a sulfur atom; $R_1$ and $R_2$ each represents a halogen atom, an alkyl group, an aryl group, an aralkyl group, an alkoxy group, an aryloxy group, a cyano group, a nitro group, a hydroxy group, a carboxy group, an alkoxycarbonyl group, an aryloxycarbonyl group, an alkylsulfonamido group, an arylsulfonamido group, an alkylsulfamoyl group, an arylsulfamoyl group, an acylamino group, an amino group, an alkylcarbamoyl group, an arylcarbamoyl group, an alkylsulfonyl group, an arylsulfonyl group, an alkylcarbonyl group or an arylcarbonyl group; $X_1$ represents a divalent organic connecting group; l is 0 or 1; and n and m each is 0, 1, 2, 3 or 4 and the total number of n+m is 1 to 8, and when n or m is 2 or more, the $R_1$ or $R_2$ groups may be the same or different.

2. A silver halide color photographic light-sensitive material as in claim 1, wherein the coupler is represented by formula (II)

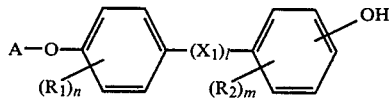

(II)

wherein A represents a coupler residue in which one hydrogen atom at the coupling position is eliminated; $R_1$ and $R_2$ each represents a halogen atom, an alkyl group, an aryl group, an aralkyl group, an alkoxy group, an aryloxy group, a cyano group, a nitro group, a hydroxy group, a carboxy group, an alkoxycarbonyl group, an aryloxycarbonyl group, an alkylsulfonamido group, an arylsulfonamido group, an alkylsulfamoyl group, an arylsulfamoyl group, an acylamino group, an amino group, an alkylcarbamoyl group, an arylcarbamoyl group, an alkylsulfonyl group, an arylsulfonyl group, an alkylcarbonyl group or an arylcarbonyl group; $X_1$ represents a divalent organic connecting group; l is 0 or 1; and n and m each is 0, 1, 2, 3 or 4 and the total number of n+m is 1 to 8, and when n or m is 2 or more the $R_1$ or $R_2$ groups may be the same or different.

3. A silver halide color photographic light-sensitive material as in claim 1, wherein the coupler is represented by formula (III)

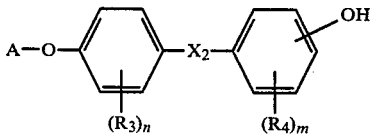

(III)

wherein A represents a coupler residue in which one hydrogen atom at the coupling position is eliminated; $R_3$ and $R_4$ each represents a halogen atom, an alkyl grop, an alkoxy group, a cyano group, a nitro group, an alkoxycarbonyl group, an aryloxycarbonyl group, an alkylsulfonyl group or an arylsulfonyl group; $X_2$ represents a divalent organic connecting group selected from an alkylene group,

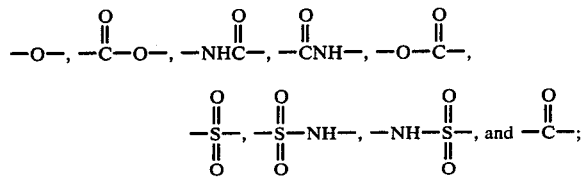

and n and m each is 0, 1, 2, 3 or 4 and the total number of m+n is 1 to 8, and when n or m is 2 or more, the $R_3$ or $R_4$ groups may be the same or different.

4. A silver halide color photographic light-sensitive material as in claim 1, wherein the coupler is represented by formula (IV)

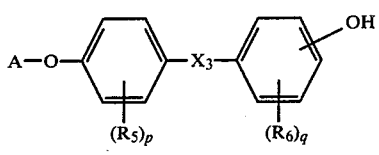

(IV)

wherein A represents a coupler residue in which one hydrogen atom at the coupling position is eliminated; $R_5$ and $R_6$ each represents a halogen atom, an alkyl group, an alkoxy group, a cyano group, a nitro group or an alkylsulfonyl group; $X_3$ represents a group selected from

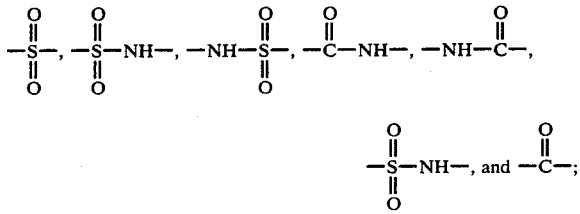

p and q each is 0, 1 or 2, and the total number of p+q is 1, 2, 3 or 4.

5. A silver halide color photographic light-sensitive material as in claim 1, wherein the coupler contains a diffusion-resistant group.

6. A silver halide color photographic light-sensitive material as in claim 2, wherein the coupler contains a diffusion-resistant group in any of the groups represented by A, $X_1$, $R_1$ and $R_2$.

7. A silver halide color photographic light-sensitive material as in claim 2, wherein A represents a yellow color image forming coupler residue of pivaloyl acetanilide type, benzoyl acetanilide type, malonic diester type, malondiamide type, dibenzoylmethane type, benzothiazolyl acetamide type, malonic ester monoamide type, benzothiazolyl acetate type, benzoxazolyl acetamide type, benzoxazolyl acetate type, benzimidazolyl acetamide type, or benzimidazolyl acetate type.

8. A silver halide color photographic light-sensitive material as in claim 2, wherein A represents a magenta color image forming coupler residue of 5-oxo-2-pyrazoline type, pyrazolobenzimidazole type, pyrazolotriazole type, cyanoacetophenone type, or pyrazoloimidazole type.

9. A silver halide color photographic light-sensitive material as in claim 2, wherein A represents a cyan color image forming coupler residue of phenol type or α-naphthol type.

10. A silver halide color photographic light-sensitive material as in claim 2, wherein A represents a substantially non-color forming coupler residue of indanone type or acetophenone type.

11. A silver halide color photographic light-sensitive material as in claim 2, wherein A represents a coupler residue represented by formula (V) or (VI)

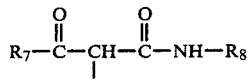

(V)

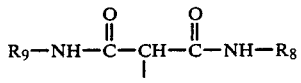

(VI)

wherein $R_7$ represents an aliphatic group, an aromatic group, an alkoxy group or a heterocyclic group; and $R_8$ and $R_9$ each represents an aromatic group or a heterocyclic group.

12. A silver halide color photographic light-sensitive material as in claim 11, wherein the aliphatic group represented by $R_7$ is an alkyl group which may be substituted with a substituent selected from an alkoxy group, an aryloxy group, an amino group, an acylamino group, and a halogen atom.

13. A silver halide color photographic light-sensitive material as in claim 11, wherein the aromatic group represented by $R_7$, $R_8$ or $R_9$ is a phenyl group which may be substituted with a substituent selected from an alkyl group, an alkenyl group, an alkoxy group, an alkoxycarbonyl group, an alkoxycarbonylamino group, an aliphatic amido group, an alkylsulfamoyl group, an alkylsulfonamido group, an alkylureido group, an alkylsubstituted succinimido group each containing 32 or less carbon atoms, an aryloxy group, an aryloxycarbonyl group, an arylcarbamoyl group, an arylamido group, an arylsulfamoyl group, an arylsulfonamido group, an arylureido group, an amino group, a hydroxy group, a carboxy group, a sulfo group, a nitro group, a cyano group, a thiocyano group, and a halogen atom.

14. A silver halide color photographic light-sensitive material as in claim 11, wherein the aromatic group represented by $R_7$, $R_8$ or $R_9$ is a naphthyl group, a quinolyl group, an isoquinolyl group, a chromanyl group, a coumaranyl group, or a tetrahydronaphthyl group.

15. A silver halide color photographic light-sensitive material as in claim 11, wherein the alkoxy group represented by $R_7$ is an alkoxy group in which the alkyl moiety represents a straight chain or branched chain alkyl group having from 1 to 32 carbon atoms, an alkenyl group, a cyclic alkyl group, or a cyclic alkenyl group, each of which may be substituted with a substituent selected from a halogen atom, an aryl group, and an alkoxy group.

16. A silver halide color photographic light-sensitive material as in claim 11, wherein the heterocyclic group represented by $R_7$, $R_8$ or $R_9$ is a group derived from a hetero ring selected from thiophene, furan, pyran, pyrrole, pyrazole, pyridine, pyrazine, pyrimidine, pyridazine, indolizine, imidazole, thiazole, oxazole, triazine, thiadiazole, and oxazine.

17. A silver halide color photographic light-sensitive material as in claim 2, wherein A represents a coupler residue represented by formula (VII), (VIII), (IX), or (X)

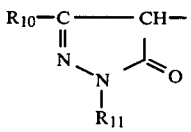
(VII)

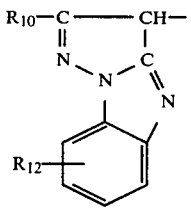
(VIII)

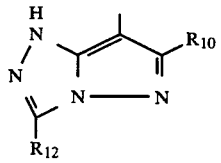
(IX)

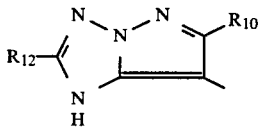
(X)

wherein $R_{11}$ represents a straight chain or branched chain alkyl group having from 1 to 32 carbon atoms, an alkenyl group, a cyclic alkyl group, an aralkyl group or a cyclic alkenyl group each of which may be substituted with a substituent selected from a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group and a mercapto group; an aryl group which may be substituted with a substituent selected from an alkyl group, an alkenyl group, a cyclic alkyl group, an aralkyl group, a cyclic alkenyl group, a halogen atom, a nitro group, a cyano group, an aryl group, an alkoxy group, an aryloxy group, a carboxy group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxy group and a mercapto group; a heterocyclic group which may be substituted with a substituent selected from the substituents as defined for the above-described aryl group; an aliphatic acyl group; an aromatic acyl group; an alkylsulfonyl group; an arylsulfonyl group; an alkylcarbamoyl group; an arylcarbamoyl group; an alkylthiocarbamoyl group; or an arylthiocarbamoyl group;

$R_{10}$ represents a hydrogen atom; a straight chain or branched chain alkyl group having from 1 to 32 carbon atoms, an alkenyl group, a cyclic alkyl group, an aralkyl group, a cyclic alkenyl group, an aryl group, or a heterocyclic group, each of which may be substituted with a substituent selected from the substituents as defined for these groups of $R_{11}$, respectively; an alkoxycarbonyl group; an aryloxycarbonyl group; an aralkyloxycarbonyl group; an alkoxy group; an aryloxy group; an alkylthio group; an arylthio group; a carboxy group; an acylamino group; a diacylamino group; an N-alkylacylamino group; an N-acylamino group; a ureido group; a urethane group; a thiourethane group; an arylamino group; an alkylamino group; a cycloamino group; a heterocyclic amino group; an alkylcarbonyl group; an arylcarbonyl group; a sulfonamido group; a carbamoyl group; a sulfamoyl group; a cyano group; a hydroxy group; a mercapto group; a halogen atom; or a sulfo group; and $R_{12}$ represents a hydrogen atom; a straight chain or branched chain alkyl group having from 1 to 32 carbon atoms, an alkenyl group, a cyclic alkyl group, an aralkyl group, a cyclic alkenyl group, an aryl group or a heterocyclic group each of which may be substituted with a substituent selected from the substituents as defined for these groups of $R_{11}$, respectively; a cyano group; an alkoxy group, an aryloxy group, a halogen atom, a carboxy group, an alkoxycarbonyl group, an aryloxycarbonyl group, an acyloxy group, a sulfo group, a sulfamoyl group, a carbamoyl group, an acylamino group, a diacylamino group, a ureido group, a urethane group, a sulfonamido group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group, or a mercapto group.

18. A silver halide color photographic light-sensitive material as in claim 17, wherein $R_{11}$ represents a phenyl group which is substituted with an alkyl group, an alkoxy group, or a halogen atom at at least one of the o-positions.

19. A silver halide color photographic light-sensitive material as in claim 2, wherein A represents a coupler residue represented by formula (XI), (XII), (XIII) or (XIV)

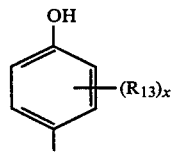
(XI)

-continued

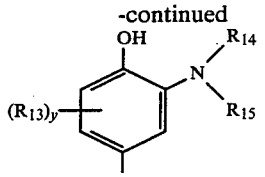

(XII)

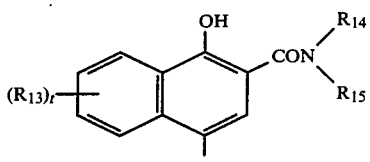

(XIII)

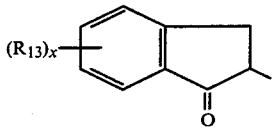

(XIV)

wherein $R_{13}$ represents a hydrogen atom, a halogen atom, an alkoxycarbonylamino group, an aliphatic hydrocarbon residue, an N-arylureido group, an acylamino group, an —O—$R_{18}$ group or an —S—$R_{18}$ group, wherein $R_{18}$ represents an aliphatic hydrocarbon residue; $R_{14}$ and $R_{15}$ each represents hydrogen, an aliphatic hydrocarbon residue, an aryl group, or a heterocyclic group, provided that not more than one of $R_{14}$ and $R_{15}$ is a hydrogen atom, or $R_{14}$ and $R_{15}$ may combine with each other to form a nitrogen-containing heterocyclic nucleus; x is an integer of 1 to 4; y is an integer of 1 to 3; and t is an integer of 1 to 5.

20. A silver halide color photographic light-sensitive material as in claim 19, wherein the aliphatic hydrocarbon group, the aryl group or the heterocyclic group represented by $R_{13}$, $R_{14}$ or $R_{15}$ may be substituted with a substituent selected from a halogen atom, a nitro group, a hydroxy group, a carboxy group, an amino group, a substituted amino group, a sulfo group, an alkyl group, an alkenyl group, an aryl group, a heterocyclic group, an alkoxy group, an aryloxy group, an arylthio group, an arylazo group, an acylamino group, a carbamoyl group, an ester group, an acyl group, an acyloxy group, a sulfonamido group, a sulfamoyl group, a sulfonyl group, and a morpholino group.

21. A silver halide color photographic light-sensitive material as in claim 2, wherein A represents a coupler residue represented by formula (XV)

$$R_{16}-\underset{|}{CH}-R_{17} \qquad \text{(XV)}$$

wherein $R_{16}$ represents an arylcarbonyl group, an alkanoyl group having from 2 to 32 carbon atoms, an arylcarbamoyl group, an alkanecarbamoyl group having from 2 to 32 carbon atoms, an alkoxycarbonyl group having from 1 to 32 carbon atoms, or an aryloxycarbonyl group each of which may be substituted with a substituent selected from an alkoxy group, an alkoxycarbonyl group, an acylamino group, an alkylsulfamoyl group, an alkylsulfonamido group, an alkylsuccinimido group, a halogen atom, a nitro group, a carboxy group, a nitrile group, an alkyl group and an aryl group; and $R_{17}$ represents an arylcarbonyl group, an alkanoyl group having from 2 to 32 carbon atoms, an arylcarbamoyl group; an alkanecarbamoyl group having from 2 to 32 carbon atoms, an alkoxycarbonyl group having from 1 to 32 carbon atoms, an aryloxycarbonyl group, an alkanesulfonyl group having from 1 to 32 carbon atoms, an arylsulfonyl group, an aryl group or a 5-membered or 6-membered heterocyclic group each of which may be substituted with a substituent selected from the substituents as defined for $R_{16}$.

22. A silver halide color photographic light-sensitive material as in claim 11, wherein A represents a coupler residue represented by formula (V) wherein $R_7$ is a tert-butyl group and $R_8$ is an aromatic group.

23. A silver halide color photographic light-sensitive material as in claim 1, wherein the coupler is present in a silver halide emulsion layer.

24. A silver halide color photographic light-sensitive material as in claim 21, wherein the coupler is present in an amount ranging from $2\times10^{-3}$ mole to $5\times10^{-1}$ mole per mole of silver in the silver halide emulsion layer.

25. A silver halide color photographic light-sensitive material as in claim 2, wherein the photographic light-sensitive material contains at least one red-sensitive silver halide emulsion layer containing a cyan color forming coupler, at least one green-sensitive silver halide emulsion layer containing a magenta color forming coupler, and at least one blue-sensitive silver halide emulsion layer containing a yellow color forming coupler, and at least one of these cyan, magenta and yellow color forming couplers is a coupler represented by formula (II).

26. A method of forming a color image which comprises developing an imagewise exposed silver halide color photographic light-sensitive material comprising a support having thereon at least one silver halide emulsion layer, the color photographic light-sensitive material containing a coupler having at the coupling position thereof a group represented by formula (I)

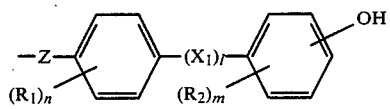

(I)

wherein Z represents an oxygen atom or a sulfur atom; $R_1$ and $R_2$ each represents a halogen atom, an alkyl group, an aryl group, an aralkyl group, an alkoxy group, an aryloxy group, a cyano group, a nitro group, a hydroxy group, a carboxy group, an alkoxycarbonyl group, an aryloxycarbonyl group, an alkylsulfonamido group, an arylsulfonamido group, an alkylsulfamoyl group, an arylsulfamoyl group, an acylamino group, an amino group, an alkylcarbamoyl group, an arylcarbamoyl group, an alkylsulfonyl group, an arylsulfonyl group, an alkylcarbonyl group or an arylcarbonyl group; $X_1$ represents a divalent organic connecting group; l is 0 or 1; and n and m each is 0, 1, 2, 3 or 4 and the total number of n+m is 1 to 8, when n or m represents 2 or more the $R_1$ or $R_2$ substituents may be the same or different, with an aqueous alkaline developing solution containing an aromatic primary amine developing agent.

27. A method of forming a color image as in claim 26, wherein the aqueous alkaline developing solution does not contain benzyl alcohol.

* * * * *